US007166066B2

(12) United States Patent
Webber

(10) Patent No.: US 7,166,066 B2
(45) Date of Patent: Jan. 23, 2007

(54) EXERCISE ARM APPARATUS FOR EXERCISE MACHINE

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 487 days.

(21) Appl. No.: 10/305,842

(22) Filed: Nov. 26, 2002

(65) Prior Publication Data

US 2003/0078141 A1 Apr. 24, 2003

Related U.S. Application Data

(63) Continuation-in-part of application No. 09/767,061, filed on Jan. 22, 2001, now Pat. No. 6,561,960.

(51) Int. Cl.
*A63B 21/00* (2006.01)

(52) U.S. Cl. ..... 482/100; 482/97; 482/137

(58) Field of Classification Search ..... 482/100, 482/137, 97, 92, 102, 103, 135–139, 142, 482/72, 73

See application file for complete search history.

(56) References Cited

U.S. PATENT DOCUMENTS 3,640,528 A 2/1972 Proctor
4,354,675 A 10/1982 Barclay et al.
4,390,179 A 6/1983 Szkalak
4,762,318 A * 8/1988 Phillips et al. ..... 482/126
5,263,914 A 11/1993 Simonson et al.
D370,040 S 5/1996 Habing et al.
6,004,247 A * 12/1999 Webber ..... 482/100
6,491,609 B1 12/2002 Webber
6,500,106 B1 * 12/2002 Fulks ..... 482/137
2003/0022767 A1 1/2003 Webber

* cited by examiner

*Primary Examiner*—Jerome W. Donnelly
(74) *Attorney, Agent, or Firm*—Procopio, Cory, Hargreaves & Savitch

(57) ABSTRACT

An exercise apparatus has a support frame and an exercise arm assembly pivotally linked to the support frame for swinging movement in at least one fixed arc about a first pivot axis, the exercise arm assembly including at least one rigid, elongate exercise arm. A flexible handle assembly is secured to the exercise arm, the handle assembly having a hand grip for gripping by a user, and a flexible line secured to the hand grip at one end and adjustably secured to the exercise arm to vary the extension of the line from the exercise arm. Upper body exercises are performed by moving the hand grip portion in different paths as permitted by the flexible line.

31 Claims, 14 Drawing Sheets

EXERCISE ARM APPARATUS FOR EXERCISE MACHINE

CROSS REFERENCE TO RELATED APPLICATIONS

This application is a Continuation-In-Part of application Ser. No. 09/767,061 field Jan. 22, 2001 now U.S. Pat. No. 6,561,960.

BACKGROUND OF THE INVENTION

This invention relates generally to an exercise arm apparatus for an exercise machine in which a handle is linked to the end of a weight or resistance bearing exercise arm for gripping by a user in performing exercises.

Exercise equipment using a handle attached to the end of a flexible line such as a rope, belt, strap or cable which is secured to a load or resistance has been known in health clubs for over a hundred years. The Lat Pulldown, Low Row, and High/Low Pulley are examples of this type of equipment. Each machine will allow the user to perform multiple exercises. This can be accomplished in a number of ways, such as a slight variation in the direction of push/pull, thereby involving different muscle groups, by changing body position, by changing the body part used (arms, legs, neck, etc.) or simply by changing the type of handle attachment.

One advantage to these machines is that they allow the user to control and define the exercise path. Because the handle is attached to a flexible line, the user determines the direction of movement and can adjust or fine-tune the exercise path to suit their needs. This allows the machines to more readily accommodate users of various sizes and shapes. It also allows the user to guide the handle so that it will traverse through multiple planes. This increases the number of muscles used by involving primary, secondary, and stabilizing muscle groups, and will not only increase muscular strength, but also improve balance and coordination, as is typical with free weight exercises, which are often considered the most beneficial.

One machine of this type was known as a High/Low pulley. This machine has a continuous cable and pulley system, connected with a load, which ends with two pulleys, placed at different elevations, providing various exercises. This machine was designed to perform a wide variety of both pushing and pulling exercises and allowed the user to define the exercise path and perform exercises that involved multiple muscle groups at the same time.

Some known designs attach handles directly to flexible, resilient bands. These bands act as both the flexible line and the resistance at the same time. This design has several drawbacks. First, the resistance cannot be adjusted unless the entire band is replaced. Second, the more the band is stretched, the harder it becomes to move the handles, which can restrict the user's ability to direct the handles in the desired path.

Other machines of this general type use a handle attached to a flexible line and designed to perform a specific exercise working a specific muscle group. Lat Pulldown and Low Row machines are examples of this type of equipment. The flexible line allows the user to adjust the path of the handle to fit their needs.

One drawback of most prior art exercise equipment using flexible lines is the size. They are generally very tall, very long, or both, which can pose problems when low ceilings or limited floor space are an issue. Some machines have therefore been designed to solve the size issue, and these typically have rigid movement arms and rigid handles that can traverse through multiple planes to follow a natural movement pattern, but require less space than flexible line equipment. U.S. Pat. Nos. 5,582,564 of Nichols, Sr., et al. and 5,967,954 of Habing are examples of this type of machine. Some machines with rigid movement exercise arms and fixed handles offer bi-directional movement, such as U.S. Pat. Nos. 6,090,020 of Webber and 5,549,530 of Fulks. These machines lack the versatility of flexible line machines, as they are used exclusively for upper body exercises, but they provide a greater level of stability and safety than their flexible line counterparts. Machines with rigid movement arms and handles can provide two, three, or even four-dimensional movement, but are usually exercise or muscle group specific. They either perform one type of exercise only, such as a chest press, or they perform multiple exercises, such as chest press and pectoral fly, that involve the same muscle group. A variation on this type of movement arm, usually found on multi-function home gyms, can perform a variety of exercises involving different muscle groups but is movement specific, meaning that the exercises will be all pressing or all pulling, dependent on the machine design.

SUMMARY OF THE INVENTION

It is an object of the present invention to provide a new and improved exercise arm apparatus for a weight lifting exercise machine.

According to one aspect of the present invention, an exercise apparatus is provided which comprises a support frame, an exercise arm assembly pivotally linked to the support frame for swinging movement in at least one fixed arc about a first pivot axis, the exercise arm assembly comprising at least one exercise arm and a handle assembly of flexible material secured to the exercise arm. The handle assembly has a hand grip portion for gripping by a user, and a flexible elongate portion extending from the hand gripping portion to the exercise arm, the flexible elongate portion comprising a flexible line which is adjustably secured to the exercise arm to vary the extension of the line from the exercise arm.

The exercise arm assembly may comprise a single exercise arm with a single handle or with two strap handles, or alternatively a pair of rigid exercise arms may be provided, each having a flexible handle assembly secured to it. The flexible handle assemblies may be releasably secured to the respective exercise arms, and different handles having flexible elongate portions of different lengths may be provided for selective attachment to the arms for performing different exercises. Alternatively, each handle may have a flexible elongate portion which is adjustable in length. The flexible elongate portion may be of any suitable flexible line or strap material such as rope, flexible fabric material of the type generally used in handle straps and the like, leather or plastic belt material, or similar flexible materials.

In addition to the flexible strap handle assemblies, each exercise arm may also have a rigid, pivotally attached handle for performing selected exercises. The fixed handles may be attached on an outer side of each arm, and may be used to perform pushing exercises. Additionally, an inner handle may be rigidly attached on an inner side of each arm for use in performing lat pull and mid row exercises, while the flexible handles are used for performing selected pulling exercises, such as biceps curl, upright row, and rear deltoid fly.

This invention combines a traditional fixed arc exercise arm with flexible handle assemblies to provide unrestricted four dimensional movement. Forward and rearward movement is provided by the rigid exercise arm, while inward/outward, upward/downward, and rotational movement is provided by the flexible handles. This provides the benefits of flexible line machines with the advantage of a moveable or fixed arc exercise arm, and requires less floor space than a flexible line machine. This apparatus is easier and less expensive to manufacture than traditional fixed arc exercise arms with rigid handles, and is more comfortable and easier to use. The flexible handles can readily adapt to the user's hand and wrist positioning, providing unlimited pronation and supination, as well as flexion/extension and rotation. The provision of adjustable length flexible handles, or replaceable flexible handles of different lengths, will permit a large range of different exercises to be performed with the same basic exercise arms, reducing expense and complexity.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 2:
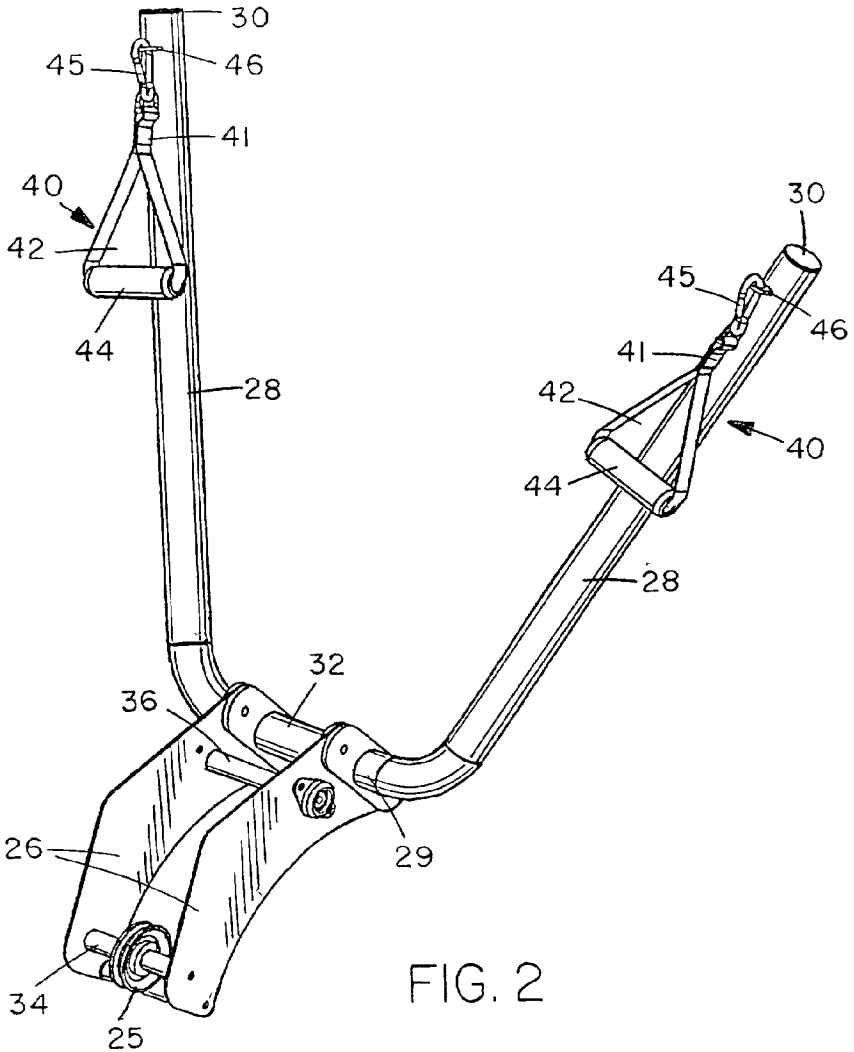
FIG. 2 is a perspective view of the exercise arm apparatus of FIG. 1.
Figure 1:
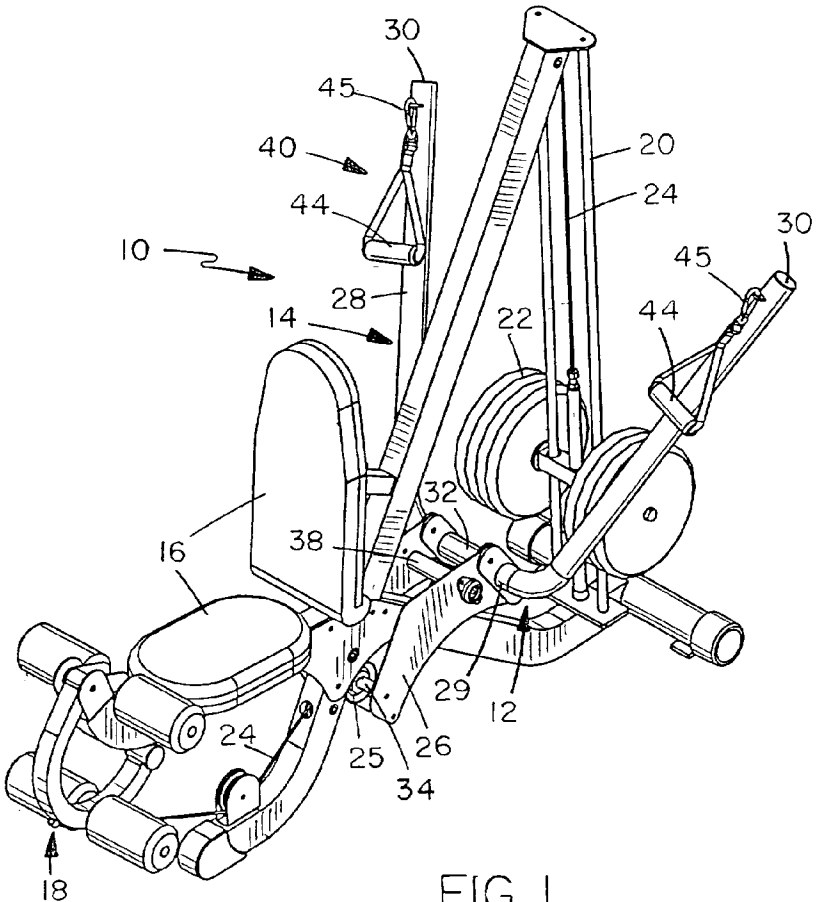
FIG. 1 is a perspective view of an exercise machine with an exercise arm apparatus according to a first embodiment of the present invention.
Figure 3:
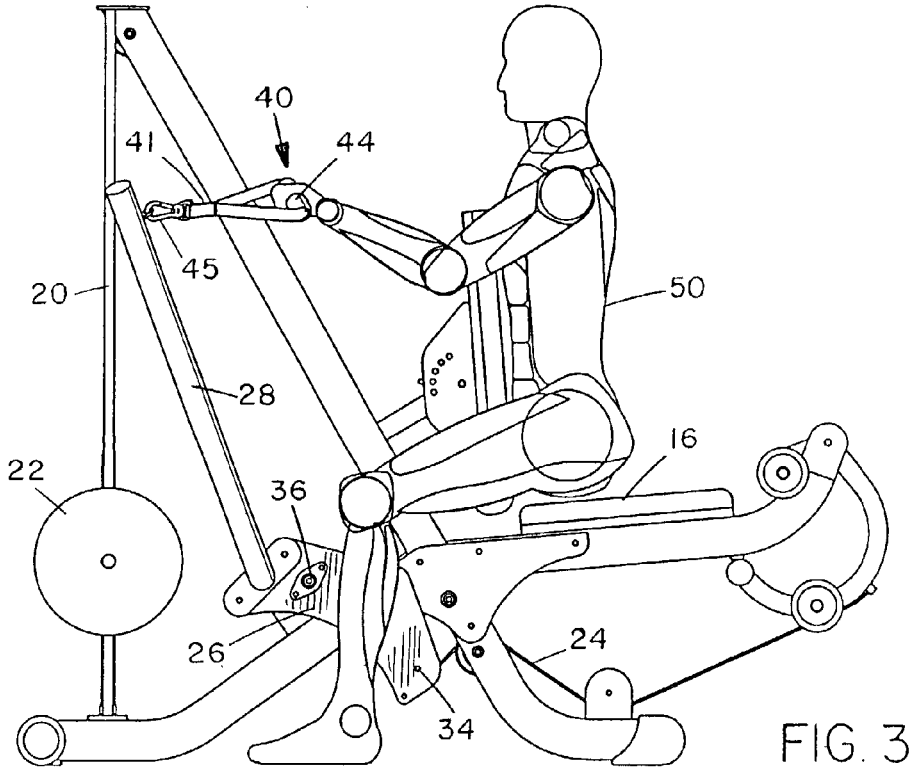
FIG. 3 is a side elevational view of the machine of FIG. 1 with a seated user performing a mid-row exercise, with a first flexible handle assembly attached to the exercise arms.

FIGS. 1 to 3 of the drawings illustrate an exercise machine 10 having an exercise arm apparatus 12 according to a first embodiment of the present invention. The machine 10 basically comprises a support frame 14 on which a seat 16 is mounted, with a leg exercise station 18 mounted in front of the seat and the exercise arm apparatus 12 mounted behind the seat. The frame 14 has a rear, upright strut 20 on which a weight carriage or transport 22 is slidably mounted. A selected number of weight plates are mounted on the weight transport. It will be understood that other types of exercise resistance may alternatively be used, such as resilient bands, springs, or the like. The weight transport is linked to both the leg exercise station 18 and the exercise arm apparatus 12 by a cable 24 extending around a pulley 25 which forms part of the exercise arm apparatus 12, as discussed in more detail below.

The exercise arm apparatus 12 is illustrated in detail in FIG. 2, and basically comprises a pair of pivot plates 26 to which a pair of rigid exercise arms 28 are secured, with each exercise arm having a first end 29 secured to an end of a respective one of the plates and a second, free end 30. The exercise arms 28 are angled slightly outwardly from opposite sides of the frame, as indicated in FIGS. 1 and 2. The plates 26 are secured together by a connecting rod 32 at their first ends to which the arms 28 are secured, and the pulley 25 is rotatably secured between the opposite ends of plates 26 on pivot pin 34, as best illustrated in FIG. 2. The plates are pivotally mounted on the frame via axle 36 which extends through a tube 38 secured to the frame by a stand-off member (not visible in the drawings) to allow the arms 28 to be pivoted backwards and forwards about the axis of axle 36.

A pair of flexible handle assemblies 40 are secured to the respective upper free ends 30 of the two arms 28. Each handle assembly is of any suitable flexible material, such as fabric, leather, or plastic belt strap material, rope, chain or the like. Each handle assembly 40 has a triangular hand grip portion 42 having a pair of outwardly diverging arms and a cylindrical hand grip 44 secured between the ends of the diverging arms, and a flexible portion 41 securing portion 42 to the respective exercise arm. Although the hand grip portion 42 is triangular in the illustrated embodiment, it will be understood that other shapes may be used in alternative embodiments such as rectangular, square, u-shaped or other open or closed shapes. The hand grip may be of foam rubber or other resilient material for comfortable gripping by a user. A metal clip member or connecting ring 45 is secured to the end of the portion 41. A ring or eyelet 46 is provided on each arm 28 adjacent end 30, and the respective clip members 45 are releasably secured to the eyelets 46. Preferably, two or more different handles 40' and 40" of different lengths are provided for selective attachment to eyelets 46, depending on the type of exercise to be performed. The handle 40' has a connecting first portion 41' of greater length than portion 41 of handle 40, while handle 40" has an even longer connecting portion 41". Handles 40' and 40" are otherwise identical to the short handle 40, and like reference numerals have been used for like parts as appropriate.

FIG. 3 illustrates a user 50 seated on seat 16 in a rearward facing position, and using the short flexible handles 40 attached to exercise arms 28 in order to perform a mid-row exercise. The user can readily rotate the hand grips 44 into a comfortable, horizontal orientation in order to perform this exercise, without needing any mechanical pivots, swivels, or universal joints in order to achieve this orientation. The shorter handles 40 will be used for performing pulling exercises such as the mid-row exercise of FIG. 3 and lat pull exercises which tend to travel in a straighter exercise path.

Figure 4:
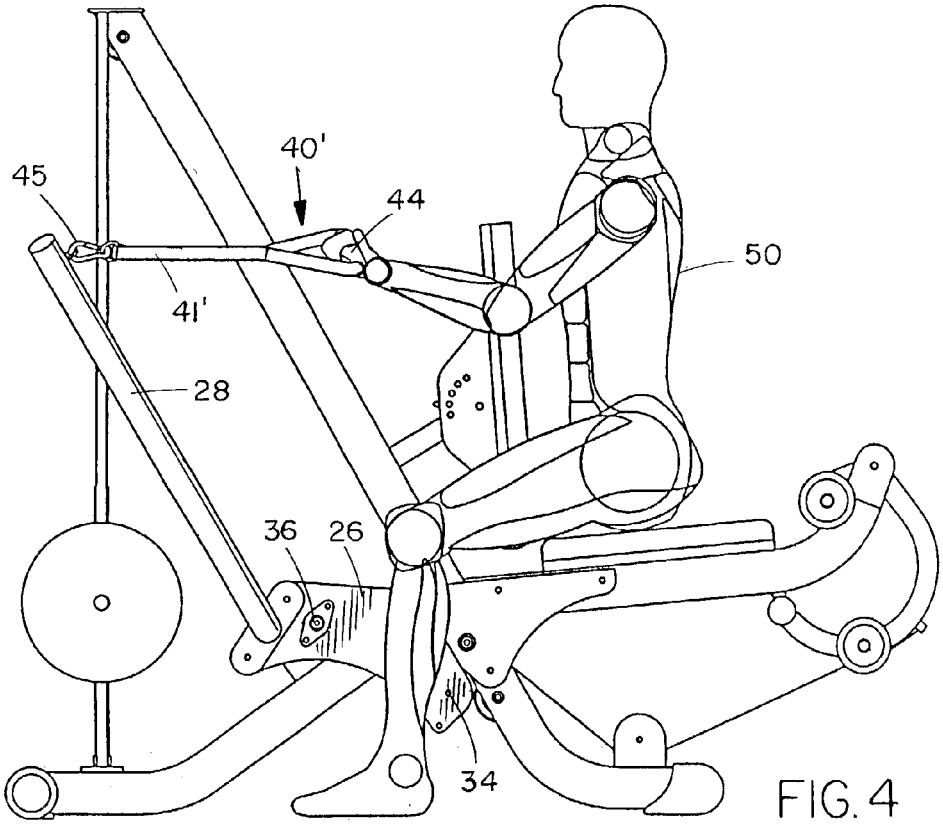
FIG. 4 is a side elevational view similar to FIG. 4 but illustrating a user performing a biceps curl exercise using a second, longer flexible handle assembly.

Other pulling exercises will require a longer handle, and can be performed using the mid-length handle 40'. Exercises which require travel in arcing or multi-planar paths, such as upright-row, rear-deltoid fly, and biceps curl, can be performed by replacing the short handle 40 with the mid-length handle 40', as illustrated in FIG. 4. FIG. 4 illustrates a user gripping the hand grips 44 of handles 40' in order to perform a biceps curl exercise. The user orients the grips 44 horizontally and then grips each handle from beneath, as illustrated, raising the forearms up and down in order to perform the biceps curl.

Figure 5:
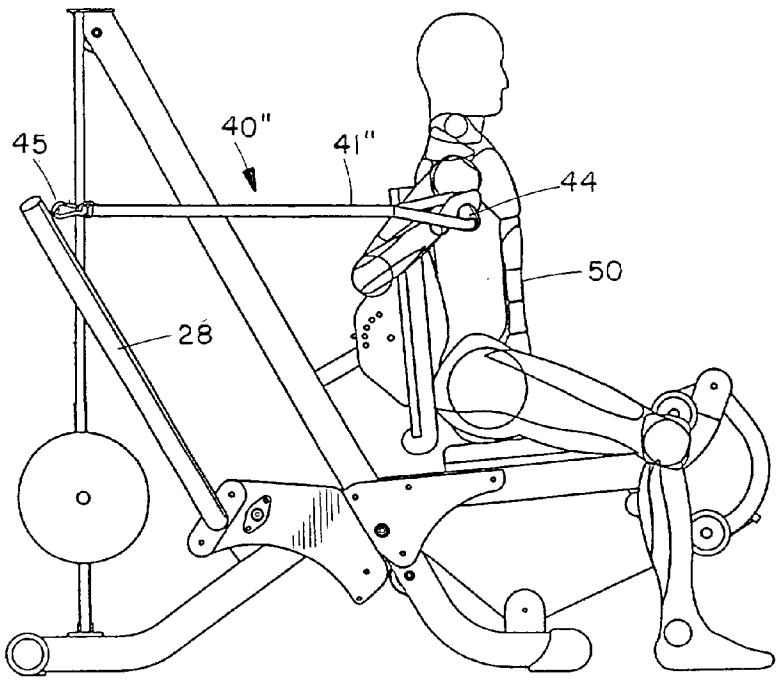
FIG. 5 is a side elevational view similar to FIGS. 3 and 4 but illustrating a user performing a chest press exercise using a third flexible handle assembly which is longer than the first two.

The longer strap handles 40" will be used to perform pushing exercises such as chest, shoulder and triceps presses or pectoral fly exercises. FIG. 5 illustrates a user using handles 40" in order to perform a chest press exercise, in which hand grips 44 are oriented horizontally and gripped from above, the user holds their hands at shoulder height, and pushes forwards against the resistance of weights 22.

Figure 6:
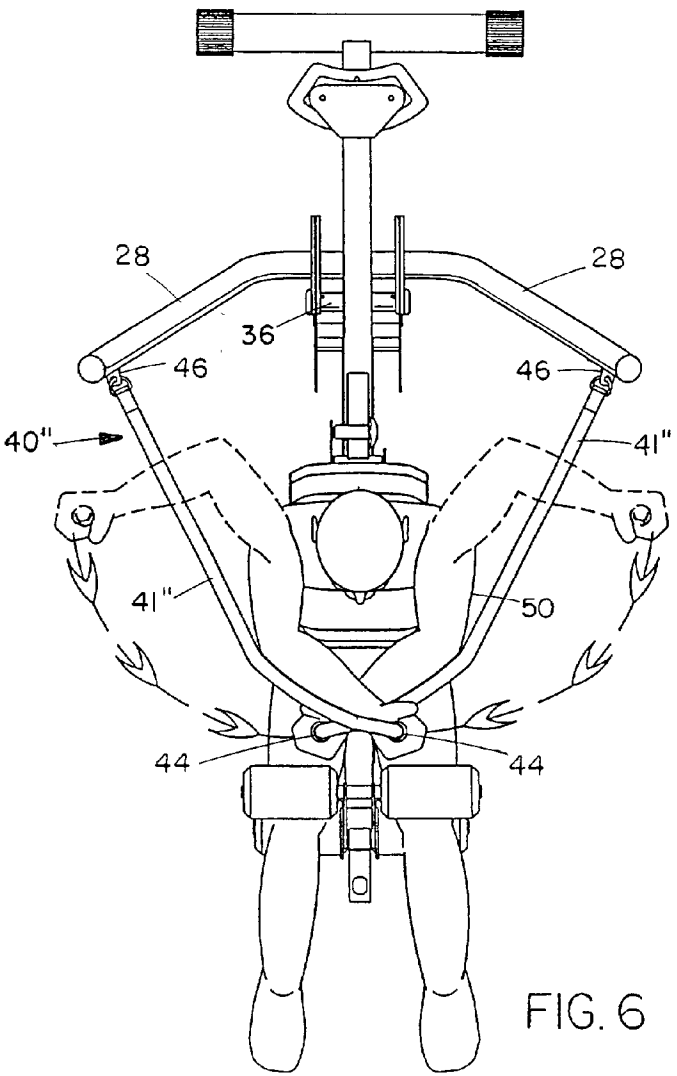
FIG. 6 is a top plan view illustrating the machine with the handle assembly of FIG. 5 and a user performing a crossover type of exercise.

FIG. 6 illustrates user 50 using the longest handles 40" to perform a crossover type of exercise such as a pectoral fly exercise. In this case, the user orients hand grips 44 vertically, then moves their hands between the dotted outline position and the solid line position in the direction of the arrows, crossing over their hands in front of their body. The soft, flexible material of the strap handles allows the straps 41" to bend around the outside of the user's arms, allowing them to complete the exercise without causing injury. A machine with rigid handles with a universal joint attachment to rigid exercise arms, such as that described in U.S. Pat. No. 6,004,247, does not permit the user to completely cross over their arms in performing such an exercise. Additionally, the rigid handles will intrude on the user's elbows and forearms. The handle assembly of this invention avoids such problems.

Figure 7A:
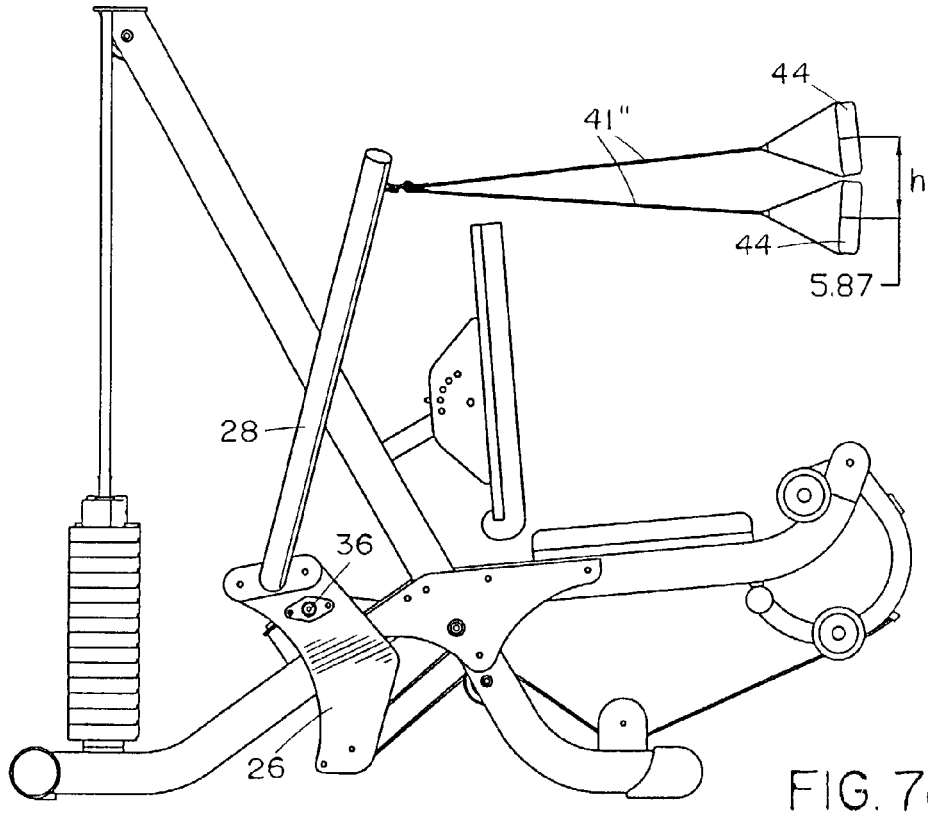
FIG. 7*a* is a side elevation view similar to FIG. 5 but omitting the exerciser and showing the difference in handle height for performing the exercise illustrated in FIG. 6 with the handles oriented vertically.
Figure 7B:
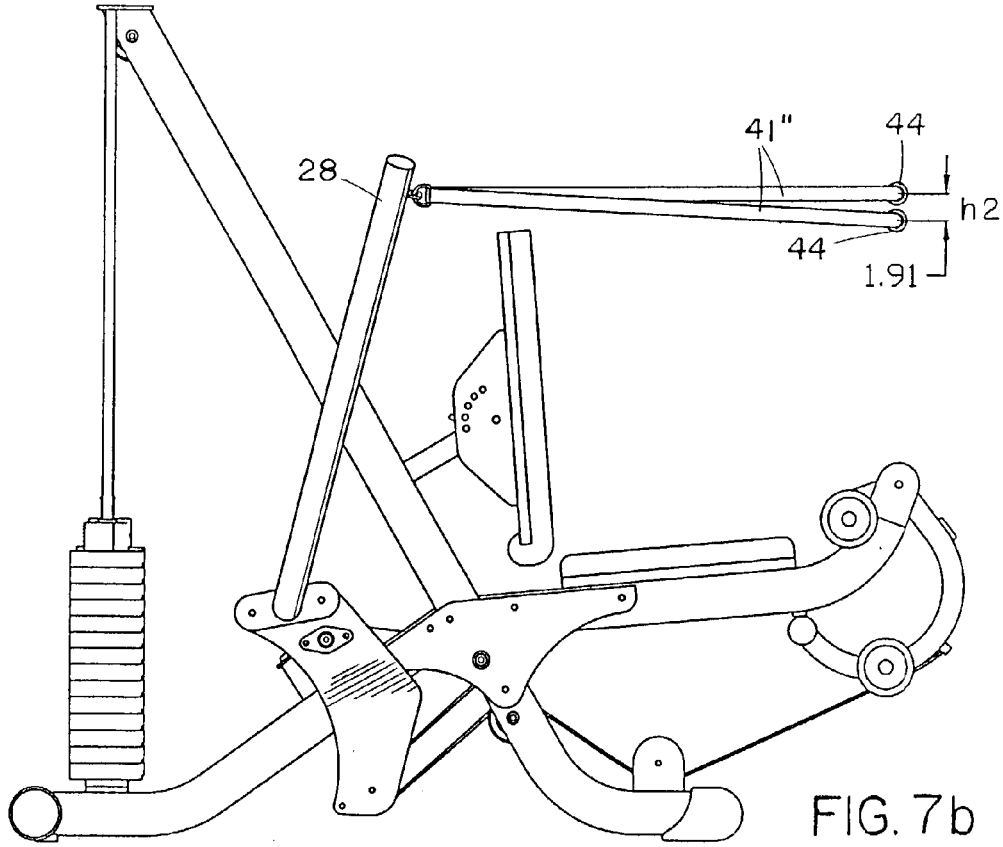
FIG. 7*b* is a view similar to FIG. 7*a* but with the handles oriented horizontally.

FIGS. 7*a* and 7*b* illustrate the difference in elevation between the user's hands when performing a cross-over exercise with the long, flexible handles 40" on the machine as illustrated in FIG. 6. FIG. 7*a* illustrates a first alternative where the user holds the hand grips 44 vertically, with the palms of their hands facing one another. This requires a difference in height h1 of approximately 5.87 inches between the hands in order to provide the necessary clearance, in contrast with a height difference of over eight inches which would be required if the same exercise movement were attempted on a machine with rigid handle arms. FIG. 7*b* illustrates the same exercise performed with the flexible handles 40" with the hand grips 44 held horizontally, with the user's hands rotated such that the palms face downwards. This requires a hand height difference h2 of only around 1.9 inches in order to provide the necessary crossover clearance. Thus, the use of the long flexible strap handles 40" allows the user to decrease the elevation difference between their hands when performing crossover exercises, and also allows this exercise to be performed with the hands oriented vertically or horizontally as in FIGS. 7*a* and 7*b*. This provides a slight variation in the exercise and the muscles used in performing the exercise.

Figure 8:
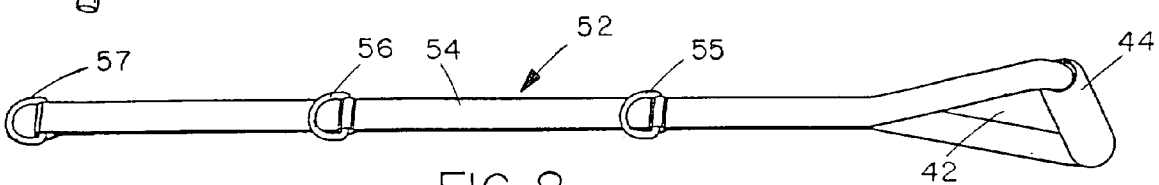
FIG. 8 is a side elevational view of a modified handle strap assembly for use in place of the different length handle assemblies of FIGS. 1 to 6.

In the embodiment of FIGS. 1 to 7, three different length strap handles 40, 40' and 40" were selectively connectable to the exercise arms 28 to perform different types of exercises, each handle having a connecting strap portion 41, 41' and 41" of different length. FIG. 8 illustrates an alternative flexible strap handle 52 which has a straight strap portion 54 with three spaced connection rings 55, 56, 57 for selective connection to eyelet 46 via clip 45 to accommodate the same three different types of exercises. The handle 52 is otherwise identical to that of FIGS. 1 to 7, and like reference numerals have been used as appropriate.

Figure 9:
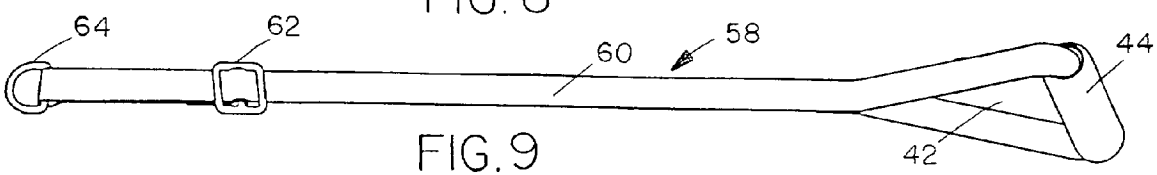
FIG. 9 is a side elevational view of another alternative adjustable handle strap assembly for use in place of the different length handle assemblies of FIGS. 1 to 6.

FIG. 9 illustrates another alternative to the three separate strap handles 40, 40' and 40". The flexible strap handle 58 of FIG. 9 has a straight strap portion 60 which has a sliding buckle 62 to provide a much wider range of length adjustment than the alternatives of FIGS. 1 to 7 and 8. The sliding buckle adjustment is similar to that found on adjustable purse and luggage shoulder straps. Handle 58 has a ring 64 at the end of adjustable portion 60 for attachment to clip 45. The handle 58 is otherwise identical to that of the previous embodiments, and like reference numerals have been used as appropriate.

Figure 10:
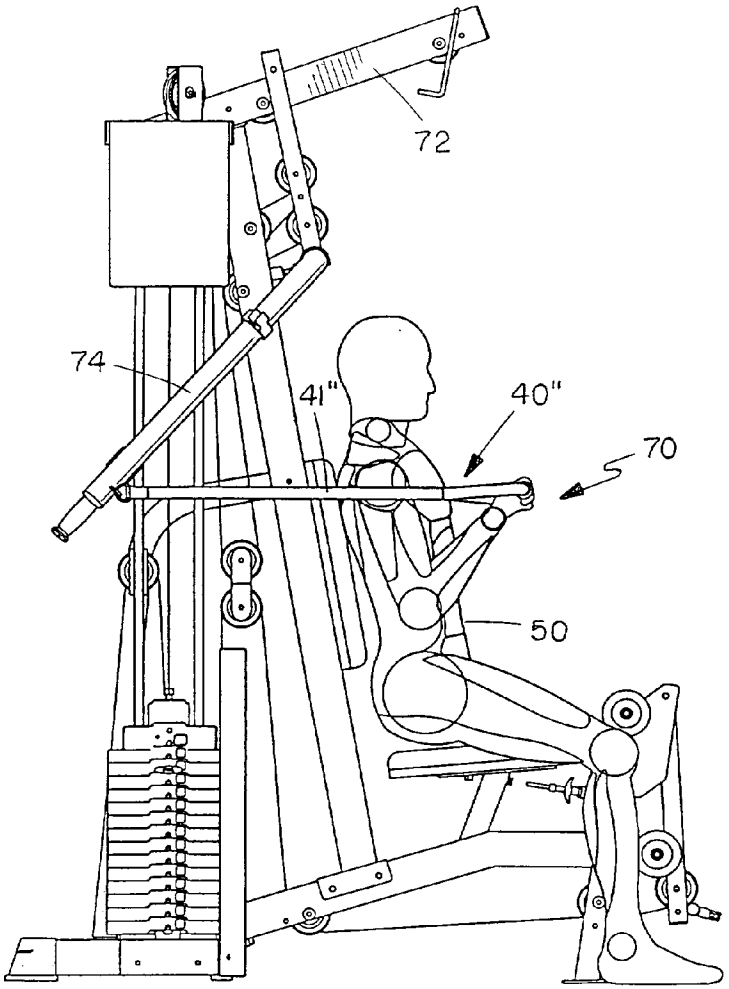
FIG. 10 is a side elevational view of a different exercise machine using a modified exercise arm assembly with the handle assemblies of FIGS. 1 to 7.

In the embodiment of FIGS. 1 to 7, flexible strap handles are secured to the ends of exercise arms which form part of an exercise arm apparatus pivotally mounted on the frame behind the user's seat. However, the handles 40, 40' or 40", or the alternative adjustable length handles of FIGS. 8 and 9, may alternatively be secured on other exercise arm assemblies on different exercise machines and positioned differently on the frame, in place of rigid handle arms. FIG. 10 illustrates a different exercise machine 70 which has a frame with a top strut 72 and a pair of exercise arms 74 pivotally suspended from the top strut 72. This is similar to the machine described in my U.S. Pat. No. 5,236,406, the contents of which are incorporated herein by reference. However, the rigid handles of that machine are replaced by flexible handle assemblies 40, 40', 40" or handles 52 or 58. FIG. 10 illustrates the longer strap handles 40" secured adjacent the end of each exercise arm 74, and a seated user 50 performing a chest press exercise by gripping the hand grips 44 at the ends of handles 40". The shorter handles 40 or 40' may alternatively be secured to arms 74 in place of handles 40" in order to perform different exercises, or the handle 40" may be replaced with one of the adjustable length handles 52 or 58.

Figure 11:
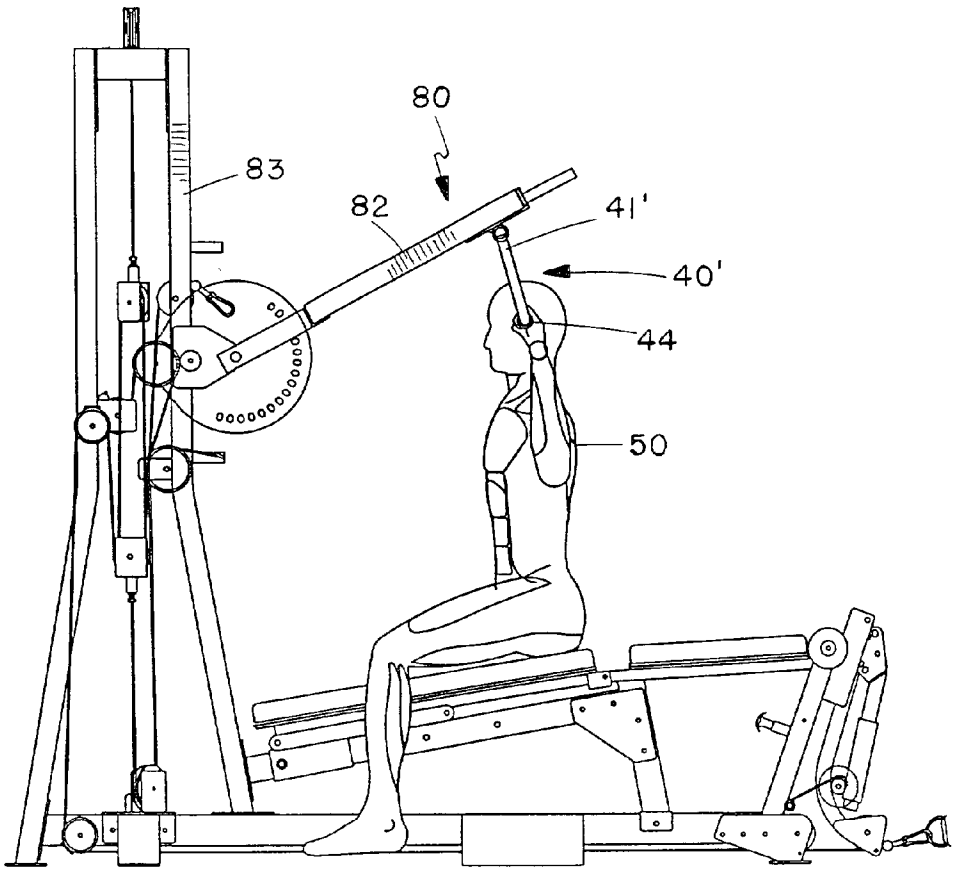
FIG. 11 is a side elevational view of another different exercise machine with a modified exercise arm assembly.
Figure 12:
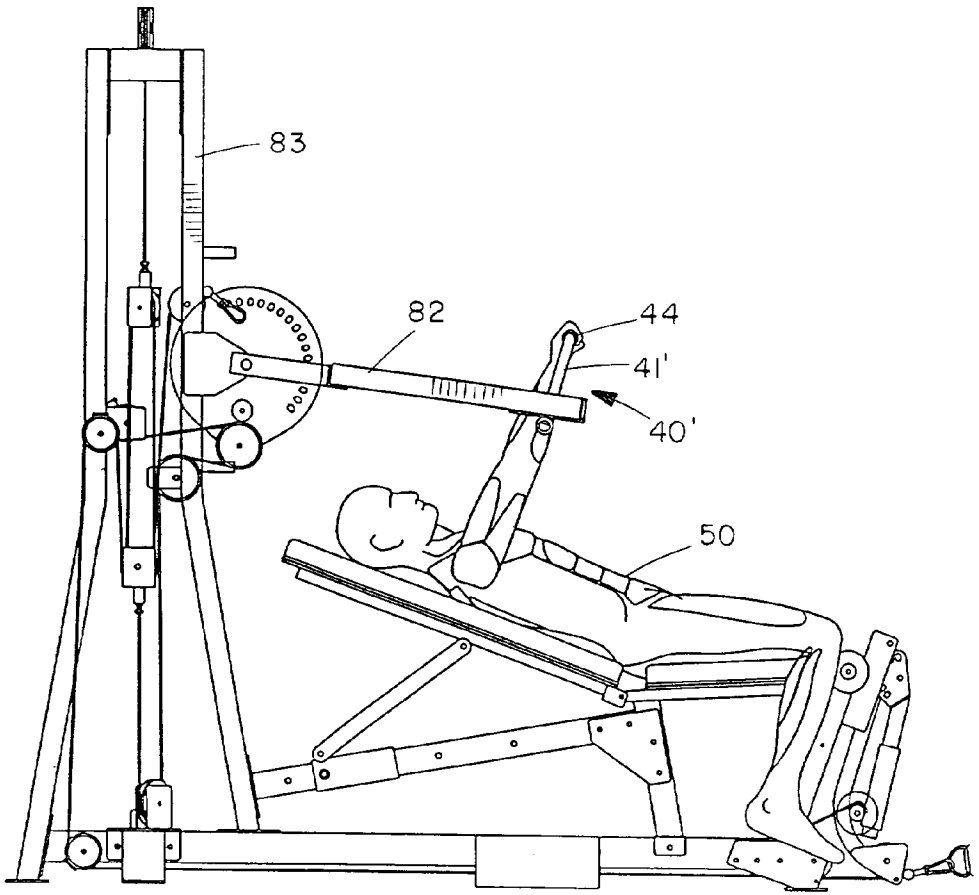
FIG. 12 is a side elevational view similar to FIG. 11 illustrating a user performing a different exercise using the exercise arm assembly.

FIGS. 11 and 12 illustrate another different exercise machine 80 in which the mid-length strap handles 40' secured to the ends of bi-directional exercise arms 82 which are pivotally mounted at an intermediate location on an upright frame member 83. The bi-directional exercise arms 82 are as described in my U.S. Pat. No. 6,090,020 issued Jul. 18, 2000, the contents of which are incorporated herein by reference. However, the rigid handles on those arms are replaced with flexible strap handles 40', and handles 40' may be replaced with any of the flexible handles 40, 40", 52 or 58 if desired. FIG. 11 illustrates a seated user 50 gripping the hand grips 44 of handles 40' in order to perform a lat pull exercise, while FIG. 12 illustrates the user performing a chest press exercise.

Figure 13:
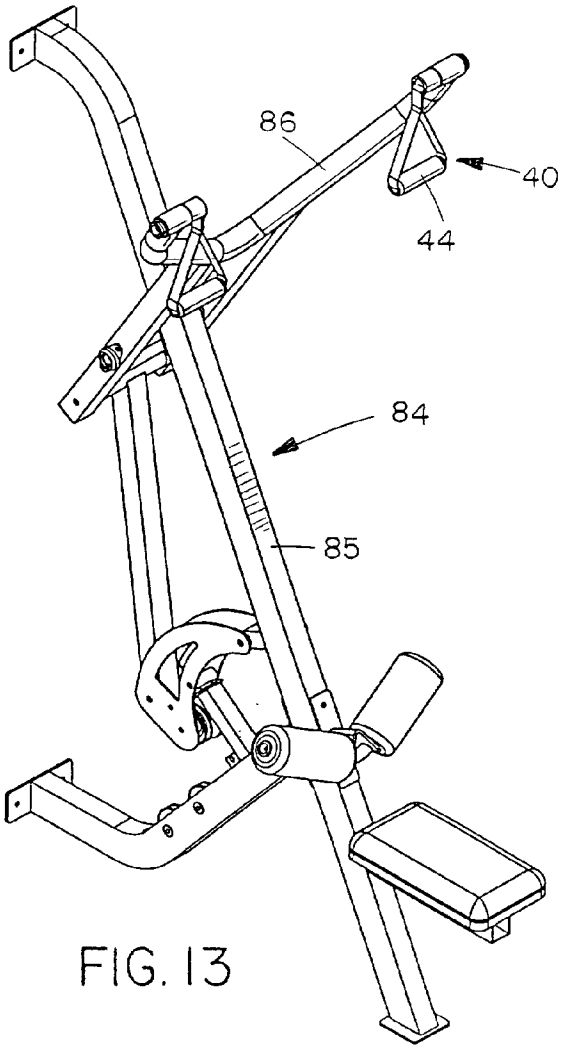
FIG. 13 is a perspective view of a different exercise machine using a modified exercise arm assembly.

FIG. 13 illustrates an exercise machine 84 having a frame 85 on which a yoke-type exercise arm 86 is pivotally mounted and suitably secured to an exercise resistance. The short flexible handles 40 are secured to the opposite ends of the yoke-type exercise arm 86, which has a four bar linkage design. Again, handles 40 may be replaced with either of the longer handles 40' or 40", or with the adjustable length handle 52 or 58 to allow a large number of different exercises to be performed.

The flexible strap handles as described above can therefore be used on any fixed arc exercise arms in place of an existing rigid handle to allow a wider variety of exercises to be performed. When secured to any exercise arm, the handles will allow the user to perform both pushing and pulling exercises and to readily control the arc, angle and elevation of the handle path for multi-planar, converging or diverging handle travel. The flexible strap handles are easily adaptable to the user's hand/wrist positioning, providing unlimited pronation/supination, as well as flexion/extension and rotation adjustment, which is not possible with a rigid handle.

Figure 15:
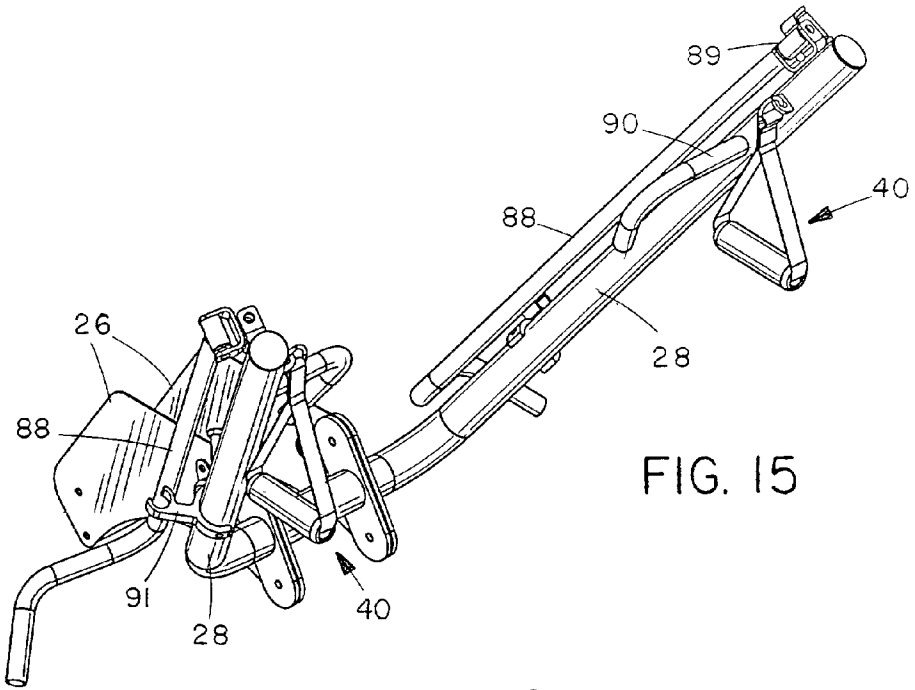
FIG. 15 is a perspective view of the assembly of FIG. 14.
Figure 14:
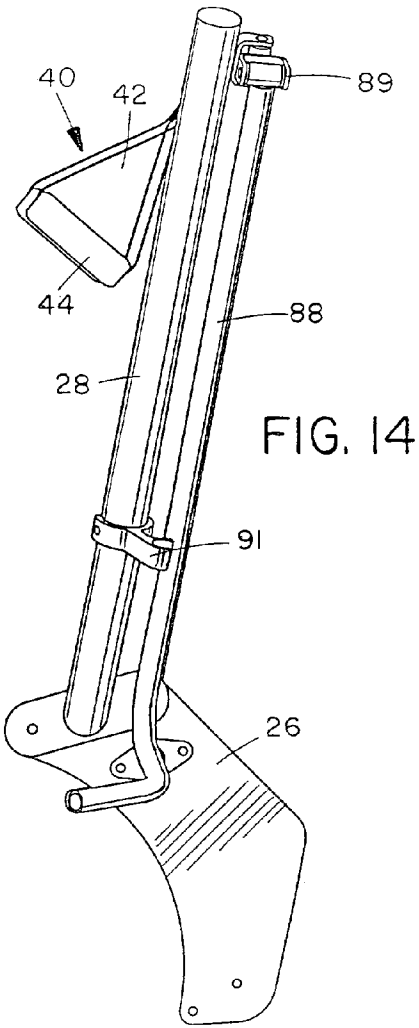
FIG. 14 is a side elevational view of an exercise arm assembly according to another embodiment of the invention.

FIGS. 14 and 15 illustrate a modification to the embodiment of FIGS. 1 to 7, and like reference numerals have been used for like parts as appropriate. In this modification, the short flexible handles 40 are shown attached adjacent the ends 30 of exercise arms 28. However, in addition to the flexible handles 40, each arm 28 also has a rigid, elongate handle arm 88 pivotally attached to the end of the arm via a three-directional pivot joint 89, and a fixed angle inner handle 90 on an inner face of each arm 28 adjacent the other two handles, as indicated in FIG. 15. When not in use, the rigid pivoted handle arms 88 are releasably retained alongside arms 28 by clips or brackets 91.

The fixed angle inner handles 90 may be used to perform lat pull and mid row exercises, while the three-dimensionally pivoted rigid handles 88 may be used for pushing exercises. The flexible handles 40 may be used to perform selected pulling exercises, such as biceps curl, upright row, and rear deltoid fly. The use of adjustable length flexible handles 52 or 58, or different length handles 40' and 40", will allow the three-dimensionally pivoted rigid handles 88 and the fixed angle inner handles 90 to be eliminated, considerably simplifying the design and making the apparatus less expensive to manufacture.

Figure 16:
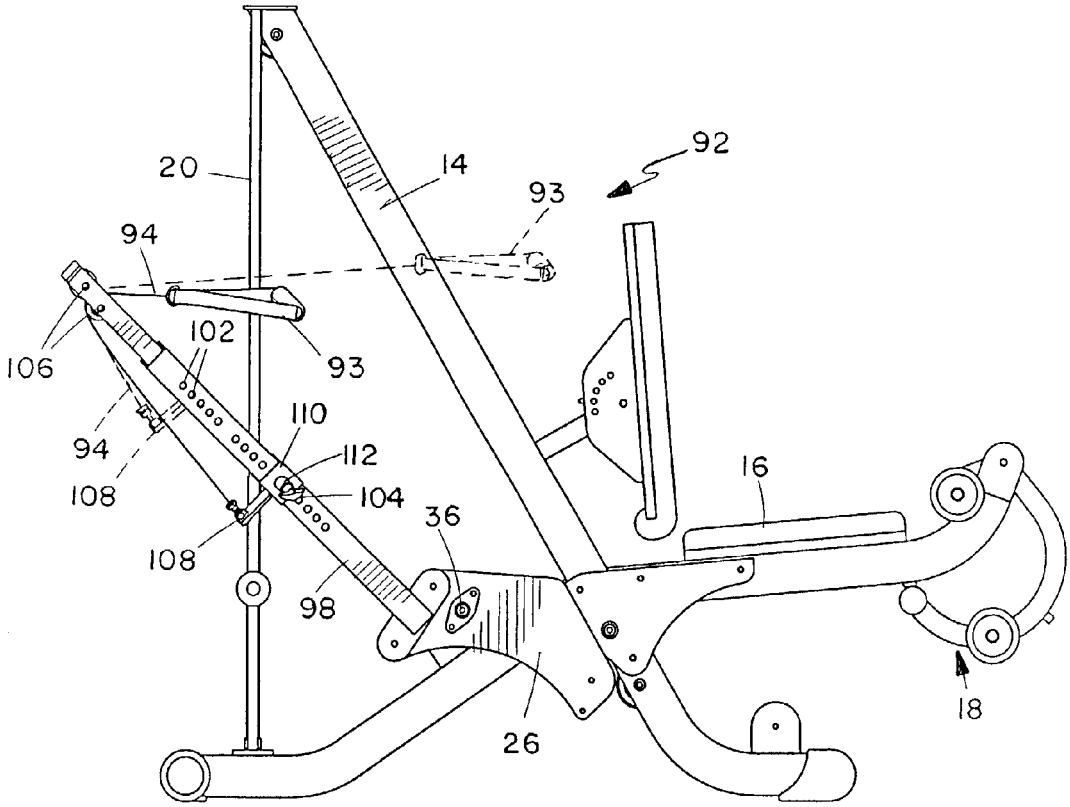
FIG. 16 is a side elevational view of an exercise machine similar to FIG. 1 having an exercise arm assembly according to another embodiment of the invention.

In the embodiments of FIGS. 1 to 15, a triangular, flexible hand grip 42 was provided at the end of a straight, flexible strap. FIG. 16 illustrates an exercise machine 92 similar to that of FIG. 1 but with an alternative handle arrangement in which a triangular flexible hand grip 93 which is the same as the triangular hand grip 42 of FIGS. 1 to 7 is attached to one end of an adjustable, flexible line 94. The machine 92 is similar to that of FIG. 1 and like reference numerals have been used for like parts as appropriate. However, the exercise arm 98 has a series of openings 102.

Line 94 extends from hand grip 42 around a guide formed between two guide pulleys 106 at the outer end of the arm, and is secured at its opposite end to a location device or anchor on a slide device 108 which is adjustably mounted on the arm 98. The slide device 108 is secured to a sleeve 110 which is slidably engaged over arm 98 and on which a pull pin 104 is mounted. Sleeve 110 has an opening 112 for alignment with a selected opening 102, so that the pull pin 104 secures the slide device 108 in a selected position.

In order to adjust the position of the handle 93 relative to the arm 98, the user releases the pinning device or pull pin 104, adjusts the sleeve 110 along the tube 98, and re-pins it at a new position. Because the line 94 is flexible, it provides movement in all directions and will move in a path determined by a user. FIG. 16 shows the handle in a retracted position for performing a mid-row exercise, while the dotted line position shows the handle in an extended position as used for performing a chest press. Although two guide pulleys 106 are preferred, one of the pulleys may be eliminated if desired, and the guide may alternatively comprise any suitable shaped surface of arm 98. A bolt or similar cable guard may be used for keeping the flexible line in the groove of the first guide pulley.

By securing the flexible strap handle 93 to a flexible line having a free end adjustably mounted on the arm, a greater range of adjustment of the handle position can be provided than is possible with the different length handles of FIGS. 1 to 9. This arrangement allows a user to perform all the major upper body exercises using only one exercise station, which is not possible in prior art exercise machines. Traditionally, prior art machines require at least three separate exercise stations, typically a pressing arm for performing all the pressing exercises, as well as mid-rows and abdominal crunch exercises, a high pulley for performing lat pulls, and a low pulley for performing biceps curl and upright rows. Since the exercise apparatus of FIG. 16 can allow all these exercises to be performed at a single exercise station, the apparatus is both cost-efficient and user friendly.

Figure 17:
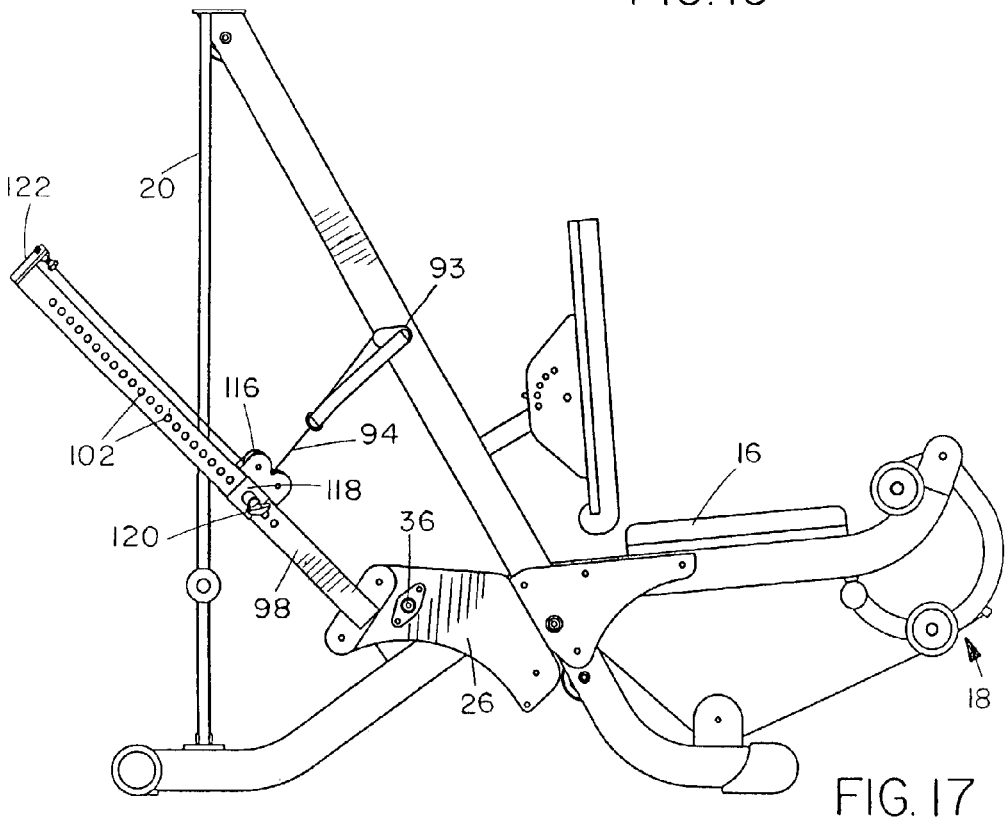
FIG. 17 is a side elevational view similar to FIG. 16 illustrating a modification of the exercise arm assembly of FIG. 16.
Figure 18:
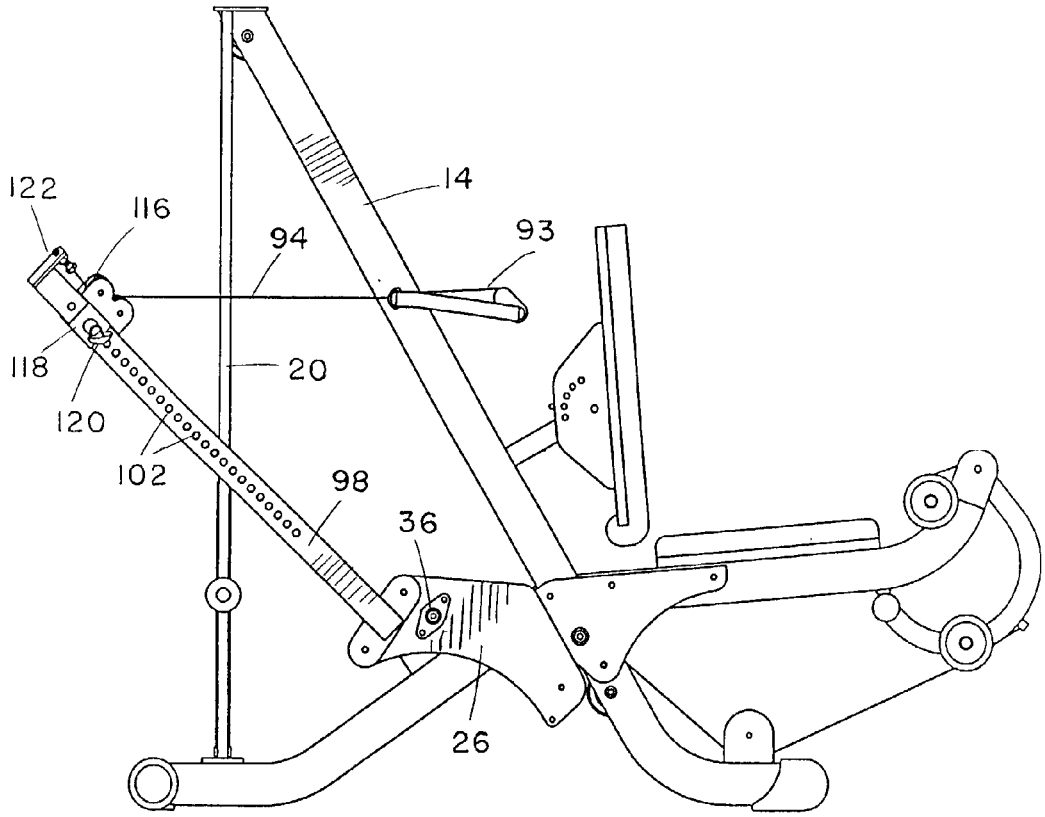
FIG. 18 is a view similar to FIG. 17 illustrating the handle in an extended position.

FIGS. 17 and 18 illustrate the machine 92 of FIG. 16 with a modified exercise arm and handle attachment. Parts of the machine of FIG. 17 are otherwise identical to those of FIGS. 1 and 16, and like reference numerals have been used as appropriate. In this version, the exercise arms 98 are each fixed in length and have a series of openings 102, as in FIG. 16. The flexible, triangular strap handle 93 is secured to one end of a flexible line 94 which extends around a first guide between two guide pulleys 116 which are rotatably secured to a slide device 118 which is slidably mounted on the exercise arm 98 and may be secured in any selected position via pinning device or pull pin 120. The line extends from the pulleys 116 upwardly along the arm, and is secured to a locating device or cable tie off at the upper end 122 of the arm.

In the embodiment of FIG. 16, the line anchor is adjustable, while in FIGS. 17 and 18 the guide pulley is adjustable in order to control the extension of hand grip 93. In FIGS. 17 and 18, as the slide device 118 is adjusted upwardly along the arm 98, the handle is extended forward. FIG. 17 shows the handle in a retracted position, with the slide device 118 secured towards the lower end of arm 98, while FIG. 18 shows the handle 93 in an extended position with the slide device 118 secured towards the top of arm 98 Because the exercise arms 98 are each on a pivot, they act as levers when pulling against the load. This means that the closer the flexible line contact point or guide 116 with the arm is to the pivot axis 36 of the arm, the greater the effort that will be required to rotate the arm about its pivot and move the load. Thus, the retracted position of FIG. 17 will require more effort to move the arm than the extended position of FIG. 18.

Figure 19:
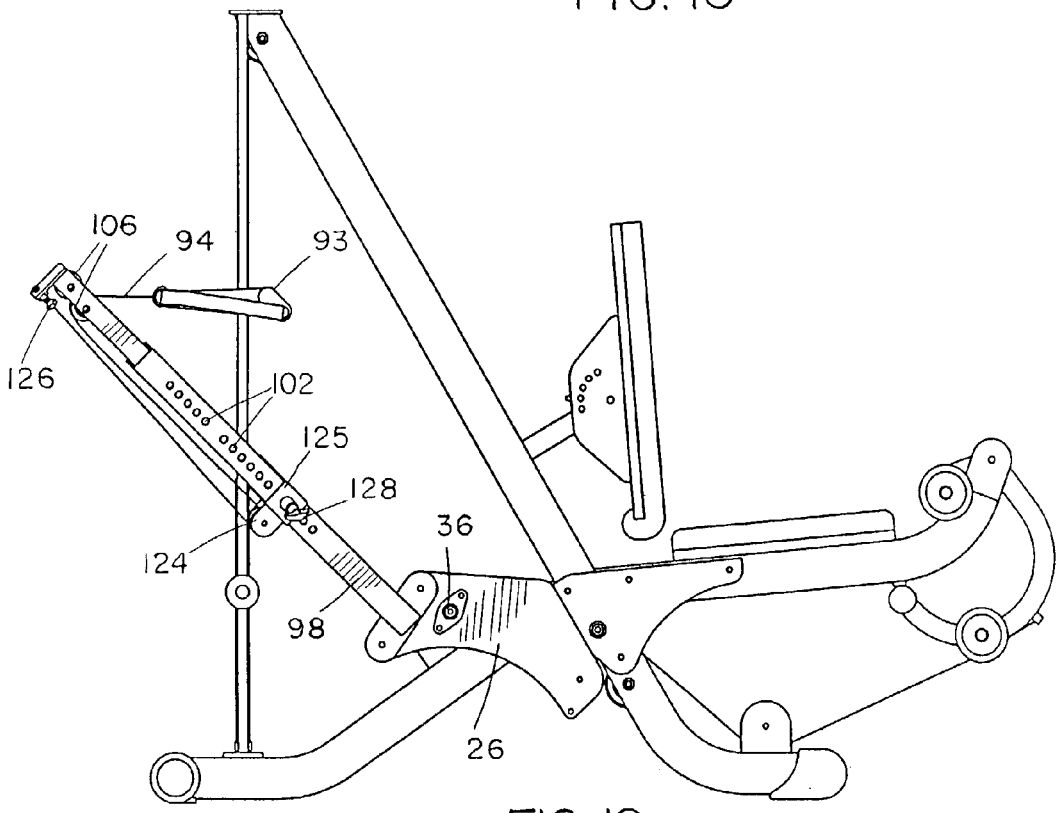
FIG. 19 is a side elevational view similar to FIGS. 16 to 18 but illustrating a modified exercise arm assembly.
Figure 20:
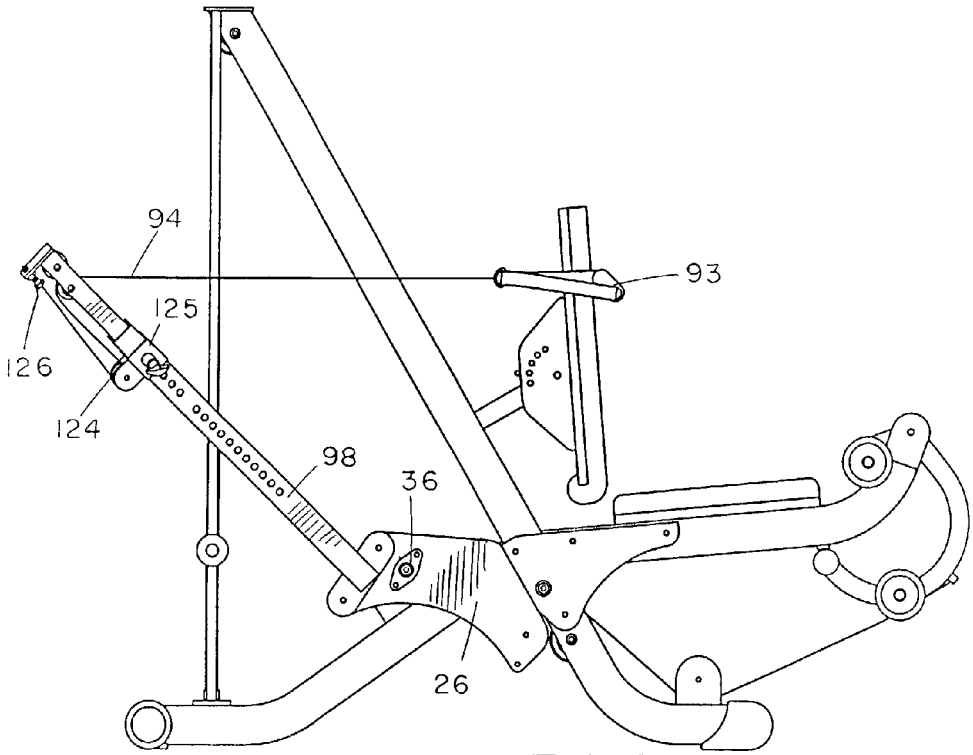
FIG. 20 is a view similar to FIG. 19 but illustrating the handle in an extended position.

FIGS. 19 and 20 illustrate another alternative arrangement using the same exercise arm 98 as FIG. 16, with a pair of guide pulleys 106 mounted at the upper end of the arm 98. However, this alternative combines the features of FIGS. 16 and FIGS. 17 and 18, since the cable 94 extends between pulleys 106, and then around an adjustable pulley 124 on a slide device 125, and back along the exercise arm to an anchor 126 at the upper end of the arm. A pull pin 128 is provided for securing the slide device 125 in a selected position. This arrangement increases the adjustability, since there is a greater length of flexible line 94 to be adjusted. Each adjustment in this version doubles the amount of line adjustment and moves the handle 93 double the distance of an equivalent adjustment in the version of FIG. 16. FIG. 19 illustrates the handle 93 in a retracted position, with the slide device 125 towards the lower end of the exercise arm 98, while FIG. 20 illustrates the handle 93 in an extended position, in which slide device 125 is close to the top of the arm 98. A comparison of FIGS. 16, 18 and 20 will illustrate that more handle extension is possible in the embodiment of FIGS. 19 and 20.

Figure 21:
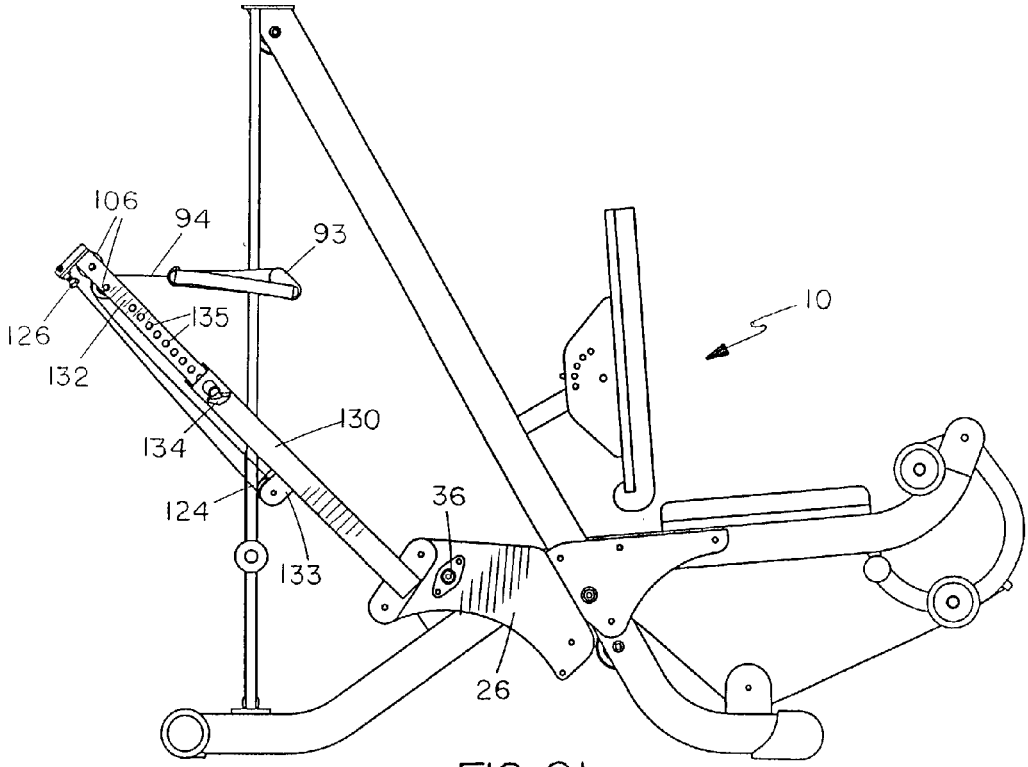
FIG. 21 is a side elevational view similar to FIGS. 16 to 20 but illustrating another modified exercise arm and handle assembly.

The embodiment of FIG. 21 illustrates a variation of the exercise arm assembly of FIGS. 19 and 20, and like reference numerals have been used as appropriate. Unlike the previous embodiments, the exercise arm in this case is formed from two telescopically engaged tubes 130, 132. Unlike the version of FIGS. 19 and 20, the additional pulley 124 in this version is secured via brackets 133 to the fixed, lower tube 130, and adjustment of the handle position is accomplished by varying the extension of tube 132 out of tube 130. FIG. 21 illustrates a retracted position of the handle 93, in which a pull pin or lock pin 134 mounted on the fixed tube 130 extends into a lower adjustment opening 135 of a series of such openings on the upper tube 132. In order to adjust the handle, the user releases pull pin 134, and slides the adjustable upper tube 132 to a new position before re-pinning the pin 134 in a new aligned opening 135. As the adjusting portion or tube 132 is moved downwardly into fixed tube 130, the flexible line contact point with guide pulleys 106 is lowered, and the handle will be extended. At the same time, the resistance felt at the handles 93 will increase as the tube 132 is lowered downwardly, closer to the pivot axle 36 of the exercise arms. In an alternative arrangement, the positions of the two sliding tubes may be reversed, with the upper tube 132 sliding over the lower fixed tube 98.

Figure 22:
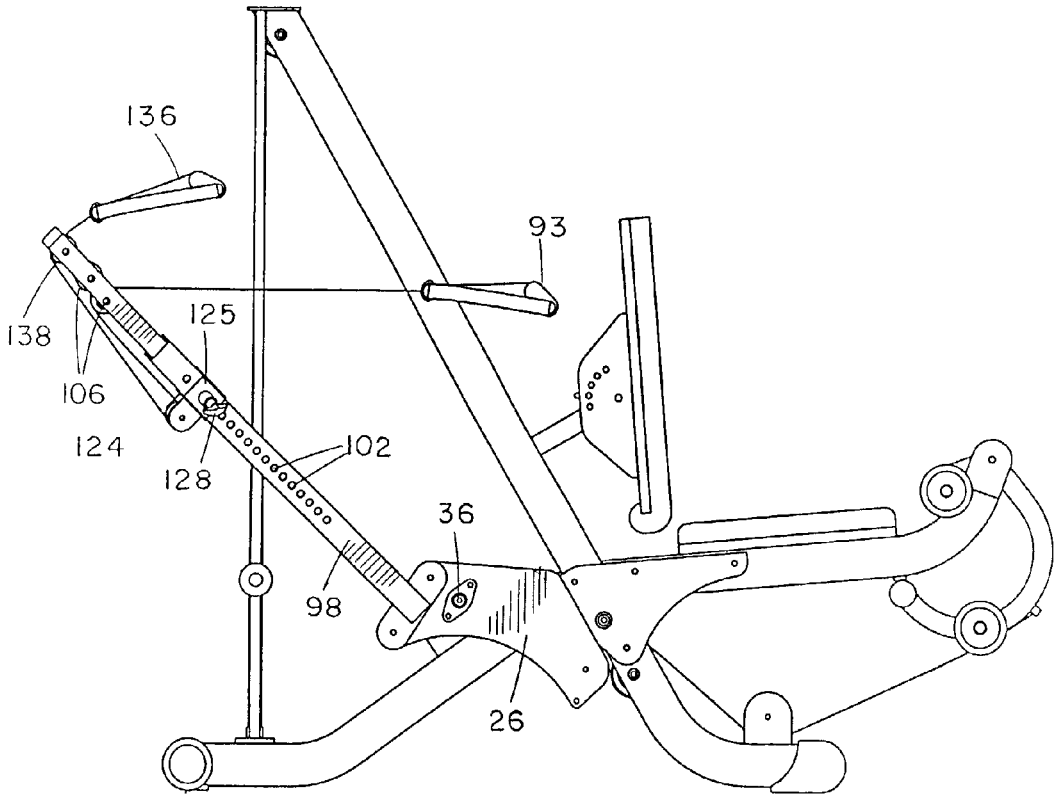
FIG. 22 is a view similar to FIG. 21 illustrating a modified, dual handle assembly.

FIG. 22 illustrates a variation of the embodiment of FIGS. 19 and 20, and like reference numerals have been used as appropriate. In FIG. 22, instead of securing an end of the flexible line 94 to a fixed anchor 126, a second handle 136 is provided which is secured to the opposite end of line 94 to handle 93, with the line extending around a further guide pulley 138 at the upper end of the exercise arm 98 before connecting to handle 136. Line 94 is routed around the first pulley 106, down around the slidable pulley 124, and back up over the extra pulley 138 mounted at the upper end of arm 98 FIG. 22 illustrates a position in which one of the handles 93 is extended and the upper handle 136 is in a retracted position. When the slide device 125 is adjusted downwardly from the position illustrated in FIG. 22, the handle 93 will be moved back inwardly towards the exercise arm. Because this is a continuous loop system, either handle can be used in any of the adjusted positions. This allows the user to pick the handle height which is best for them or for the exercise being performed.

If desired, the spacing between the handles may be changed by changing the separation between the pulleys 106 and 138. However, the greater the pulley and handle spacing, the greater the difference in resistance which will be felt by the user when using the different handles. Thus, it is preferable that the pulleys are not spaced too far apart.

Figure 23:
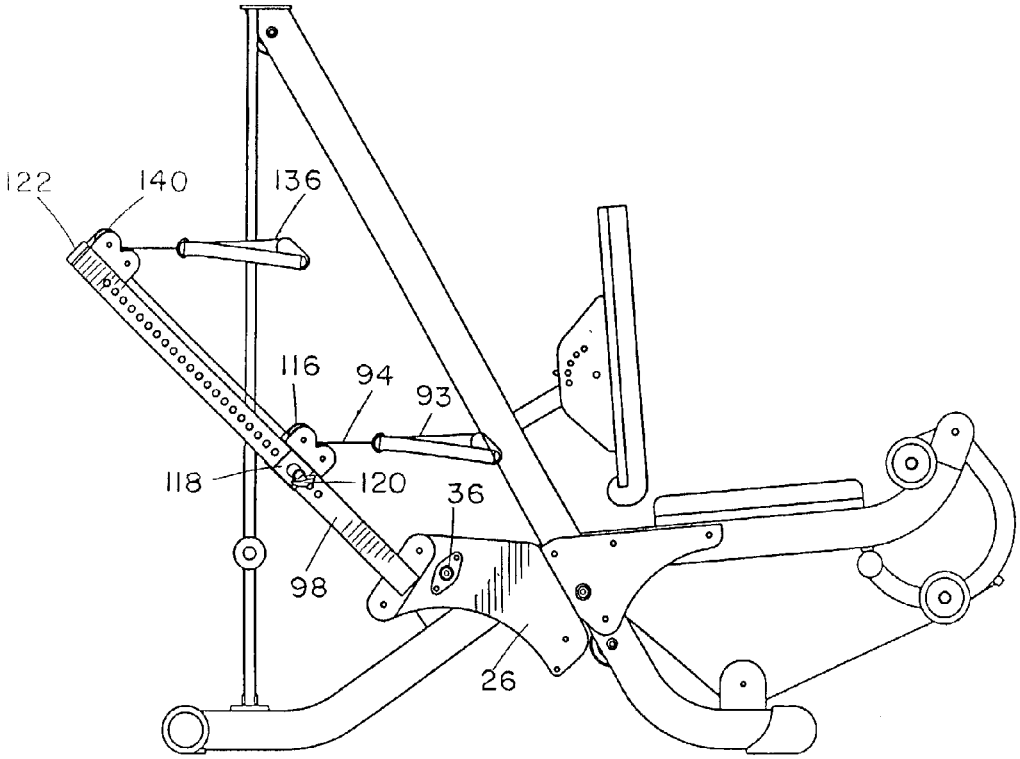
FIG. 23 is a side elevational view similar to FIG. 22 but illustrating an alternative dual handle assembly.

FIG. 23 illustrates an alternative exercise arm assembly which also has two handles 93, 136 secured to opposite ends of the flexible line 94. However, this version is a modification of the embodiment of FIG. 17, and like reference numerals have been used as appropriate. This version replaces the line attachment at the top 122 of the one-piece exercise arm 98 with an additional set of pulleys 140. The cable or line 94 extends from handle 93, between the lower set of pulleys 116, upwardly along the arm and between the upper set of pulleys 140, and is then secured to the second handle 136. When the slide device 118 is adjusted along the arm 98, the slack in the line 94 is changed and the handle positions are adjusted. As the slide device 118 is positioned closer to the pivot axle 36 of arm 98, the resistance felt at the lower handle 93 increases. This device not only allows the user to adjust the handle height for a particular exercise, but also allows the resistance to be changed, dependent on which handle is used. If the handle 93 is adjusted upwardly from the position illustrated in FIG. 23, closer to handle 136, by moving slide device 118 upwardly, the difference in resistance between the two handles will be reduced.

Figure 24:
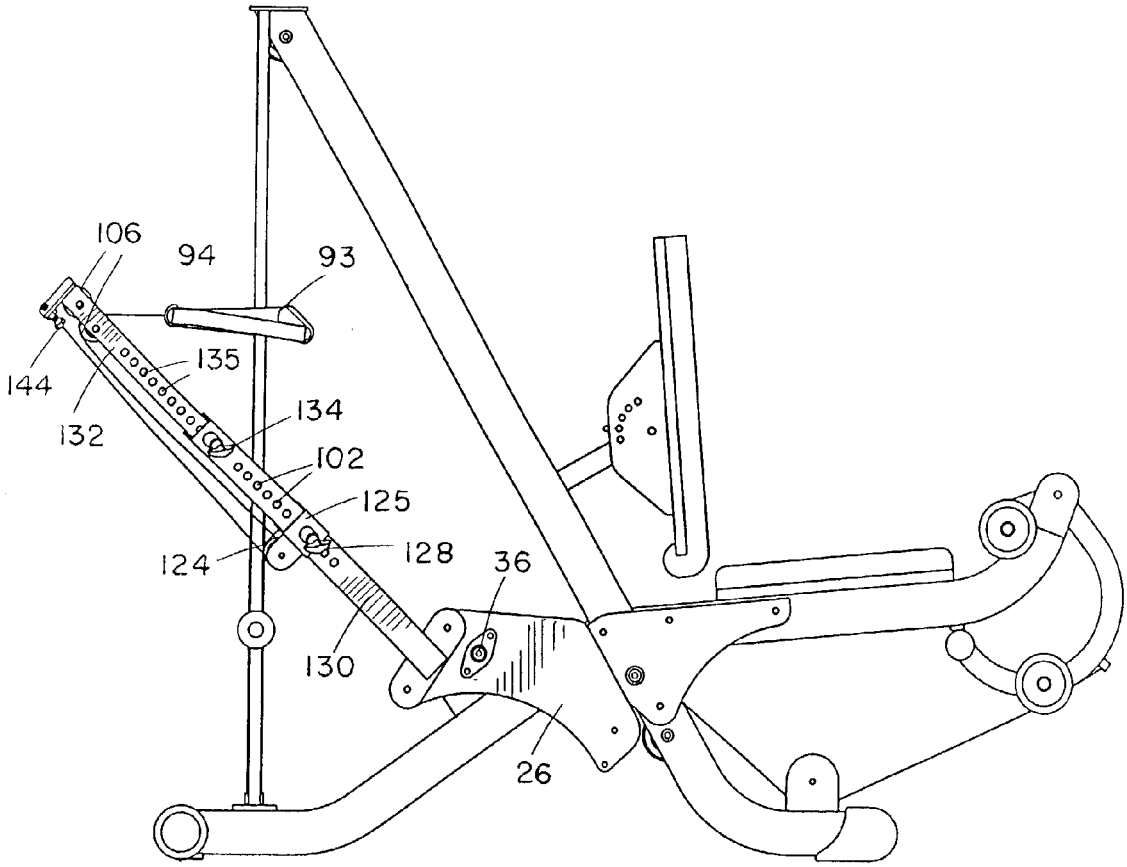
FIG. 24 is a side elevational view similar to FIGS. 16 to 23 illustrating a modified, two part adjustable exercise arm.
Figure 25:
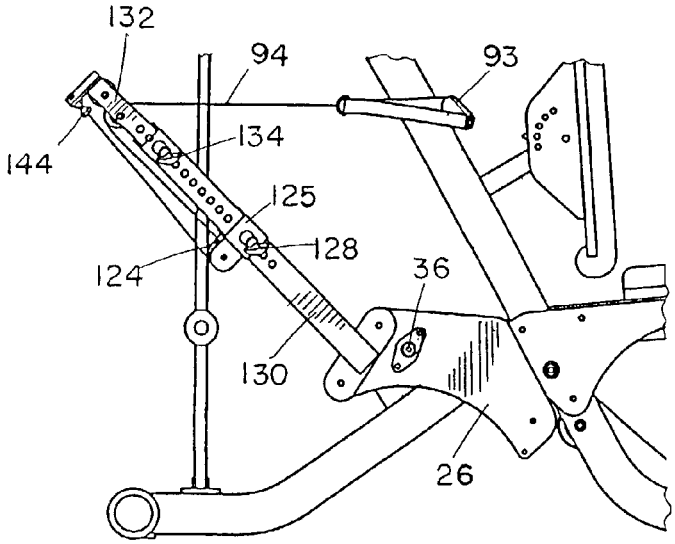
FIG. 25 is a side elevational view of the machine in FIG. 24 illustrating an adjusted exercise arm and handle position.

FIGS. 24 and 25 illustrate another modified exercise arm assembly which has a double adjustment system for the flexible line 94, combining the sliding device 125 of FIG. 19 and the two piece telescoping arm construction of FIG. 21. Like reference numerals to those used in FIGS. 19 and 21 have been used for like parts as appropriate. In this embodiment, the exercise arm has a lower, fixed tube 130 and an upper, adjustable tube 132 which engages telescopically in the lower tube and has a series of openings 135. Releasable pull pin 134 engages through an aligned opening 135 in the upper tube in order to secure the tube at a selected extension. The flexible line 94 extends from handle 93, between guide pulleys 106 at the upper end of upper tube 132, downwardly and around the adjustable pulley 124 which is adjustably mounted on lower fixed tube 130 via slide device 125, and then back upwardly to the upper end of the adjustable tube 132 where it is secured to anchor 144. In this device, the handle position can be changed by adjusting the slide device 125, by adjusting the extension of sliding arm 132, or both. This offers greater choices in handle height placement, handle retraction/extension, and handle resistance. The line attachment at anchor 144 may be replaced with an additional pulley, as in FIG. 22, and an extra handle may be attached to the opposite end of the line, offering even greater adjustment possibilities. It will be understood that the telescoping tubes 130, 132 may be reversed, with the lower fixed tube telescopically engaging inside the upper, adjustable tube, rather than the other way around as is illustrated in FIG. 24. FIG. 24 illustrates the handle 93 in a retracted position with the upper tube 132 extended, while FIG. 25 illustrates a retracted position of tube 132, lowering the height of handle 93, and extending the handle outwardly. The handle can be extended at the same height as FIG. 24 simply by raising the slide device 125, and can be extended further than indicated in FIG. 25 also by raising slide device 125.

In each of the embodiments of FIGS. 16 to 24, where the handle or handles are attached to one or both ends of a flexible line, the line 94 may be a belt, cable, rope, chain or the like. Different styles of handles may also be attached to the flexible line. Different pinning devices from the illustrated pull or pop pins may be used, such as a straight pin, tension knob, or the like. Guide pulleys are used for ease of adjustment purposes, but they are not essential, since the flexible line 94 may be bent around almost any guide surface, such as the end of the exercise arm. The relationship between the location of the exercise arm pivot and the resistance or load connection point may also be varied.

In all of the embodiments of FIGS. 1 to 25, the exercise machine uses a cable and pulley linkage to the load which allows the cable to carry on to another exercise station, such as the leg exercise station 18 illustrated in the drawings. However, different resistance linkages and alternative cable and pulley arrangements could be used in other embodiments. For example, the cable may terminate at the exercise arm, or the exercise arm may be linked to the load using a non-cable linkage. Also, different resistance devices or loads may be used in place of the stacked weights 22, such as selector plates, springs, resilient bands, hydraulic or gas shocks, or the like. Each of the different embodiments of this invention may be used for either a single or multi-function exercise machine, and the flexible handle assembly may be attached to any type of pivoted exercise arm, such as bi-lateral exercise arms with both sides dependent and traveling together, for example as illustrated in FIGS. 1 to 7 and 13, or uni-lateral exercise arms with each side independent and traveling separately, or bi-directional exercise arms as illustrated in FIGS. 11 and 12. These exercise arms, either unidirectional or bi-directional, may be pivoted to a top strut of the frame, an upright strut, or the lower part of the frame.

Figure 26:
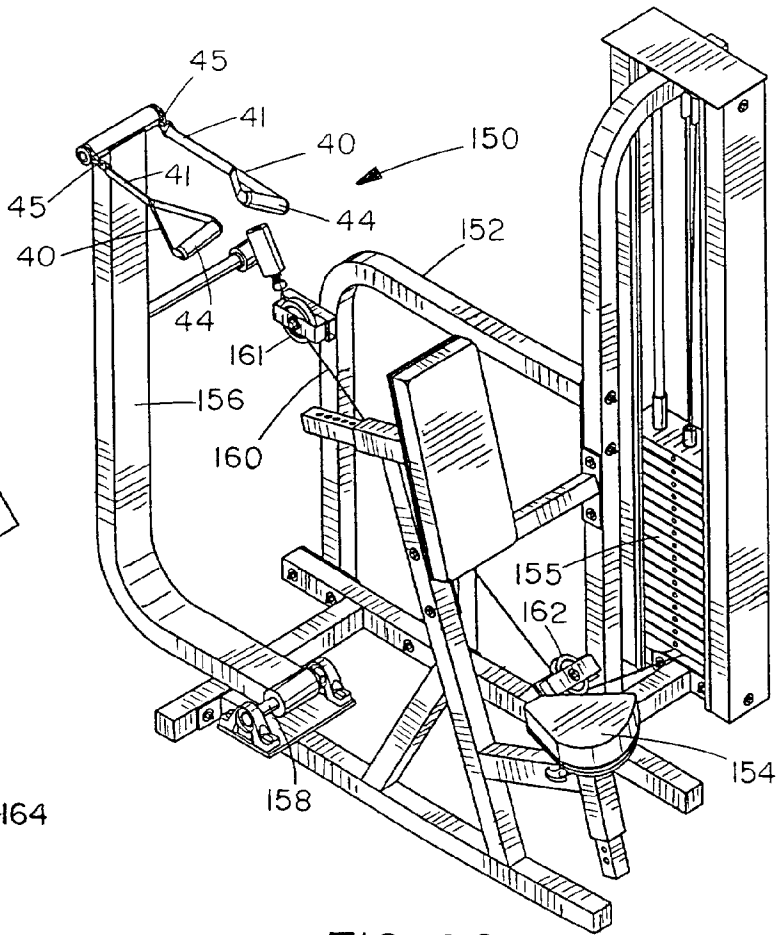
FIG. 26 is a perspective view of an exercise arm apparatus according to another embodiment of the invention.
Figure 27:
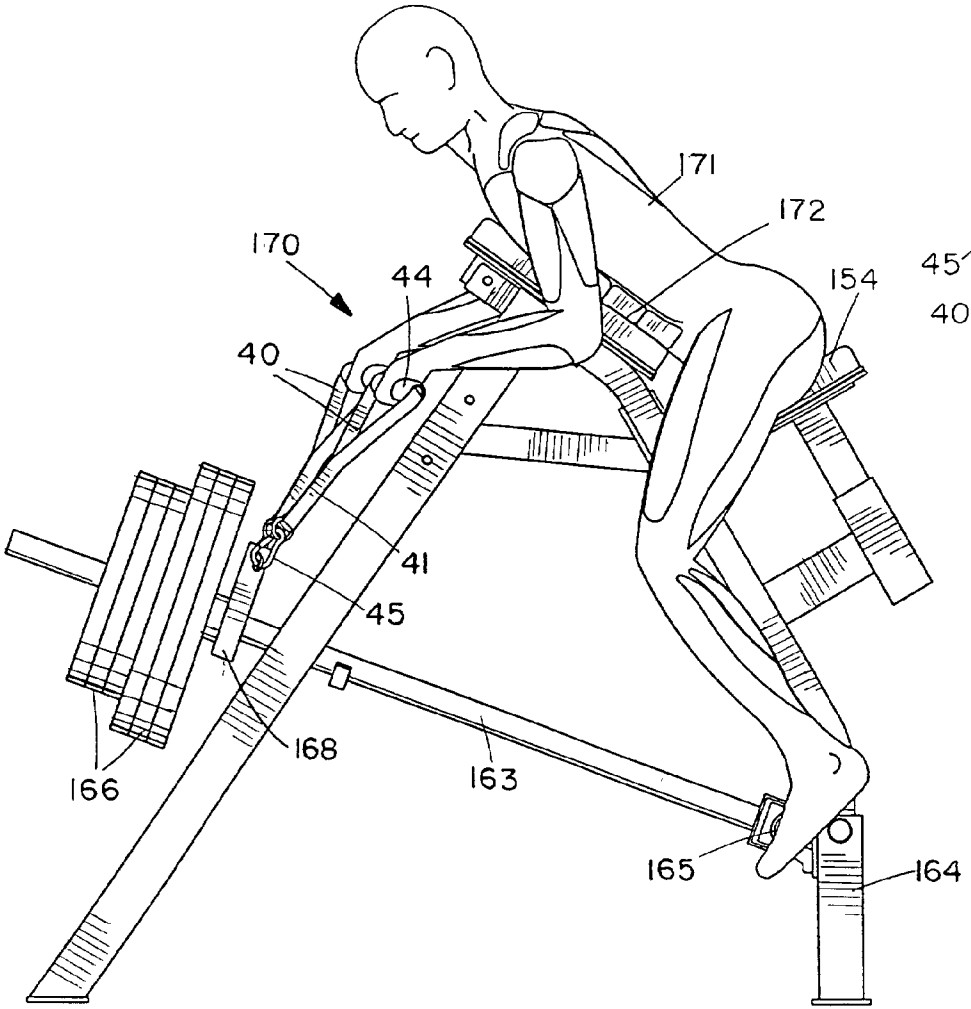
FIG. 27 is a side elevational view illustrating another modified exercise arm assembly.

In all of the previous embodiments, the exercise arm assembly comprises a pair of rigid exercise arms with a flexible handle secured to each arm via a flexible connecting portion. However, a single arm with one strap handle may be used, or a single exercise arm may have two flexible strap handles. In the embodiments of FIGS. 26 and 27, two flexible handle assemblies are secured to a single exercise arm. FIG. 26 illustrates an exercise machine 150 having a support frame 152, a seat 154 on the frame for supporting a user, a vertically mounted weight stack 155, and a single exercise arm 156 pivotally mounted on the frame via pivot 158 in front of the seat 154 and linked to the weight stack via a cable 160 extending over a series of pulleys 161, 162. It will be understood that different types of exercise resistance may be used in place of the weight stack, such as resilient bands, springs, or weight plates mounted on a sliding transport, as discussed above.

A pair of flexible handle assemblies 40 are mounted at the upper end of arm 156. Handle assemblies 40 are identical to those of the first embodiment, and like reference numerals have been used for like parts as appropriate. It will be understood that the connecting portion 41 of the strap handles may be of different lengths or may be adjustable in length, as in the previous embodiments. The user sits on seat 154 facing the arm 156, grips a handle 44 in each hand, and pulls the arm towards their body against the exercise resistance in order to perform exercises.

FIG. 27 illustrates another modified exercise arm assembly 170, in which an elongate exercise arm 163 is pivotally mounted on a frame 164 via pivot 165. Weight plates 166 are removably mounted over the upper end of arm 163 for exercise resistance. A pair of flexible handle assemblies 40 identical to those of FIGS. 1 to 7 are secured to an anchor plate 168 on the arm below the weight plates 166. An exerciser 171 on seat 154 faces the arm 163 and grips the handle grips 44 to pull the arm towards his or her body in order to perform exercises, leaning against chest pad 172. Again, the flexible connecting portion 41 of each handle may be of different lengths or adjustable in length, as in FIGS. 1 to 7. Instead of providing two separate handle assemblies 40, a single flexible handle assembly may be secured to arm 163 or arm 156, with a wider hand grip portion for gripping by both the user's hands.

Any of the various adjustable strap handle designs of FIGS. 16 to 24 may be used on the arm 156 of FIG. 26 or the arm 163 of FIG. 27, with modification of the respective arms to allow the line extension adjustment. In this case, two strap handles 93 will be secured to the end of the line 94. Alternatively, the single arm 156 of FIG. 26 may be replaced with two arms which pivot side-by-side. Each arm may have a single strap handle 40 attached, or an adjustable strap handle as in any of FIGS. 16 to 24 may alternatively be used. Similarly, the single arm 163 of FIG. 27 may be replaced by two separate and independent arms. Each arm may have a single strap handle 40, 41 secured as in FIG. 27. Alternatively, any of the adjustable strap handle arrangements of FIGS. 16 to 24 may be used.

Figure 28:
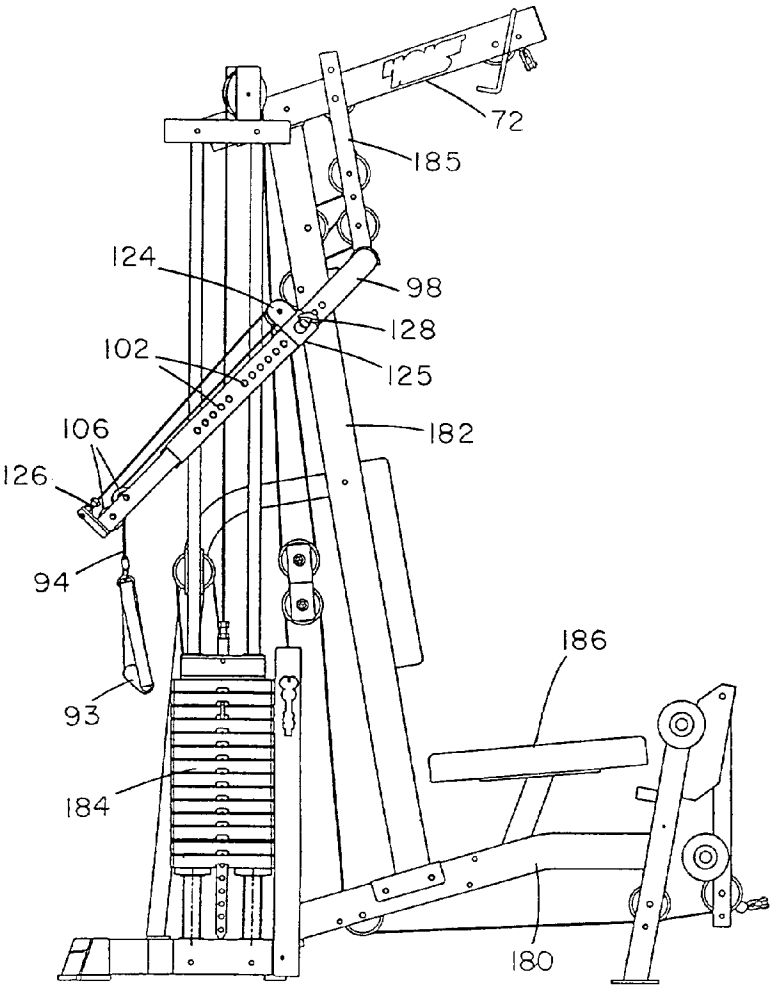
FIG. 28 is a side elevational view illustrating another modified exercise machine.

FIG. 28 is a side elevational view of an exercise machine similar to that illustrated in FIG. 10 but with the exercise arms 98 and strap handle assembly of FIG. 19 replacing the exercise arms 74 of FIG. 10. The machine of FIG. 28 is otherwise identical to that of FIG. 10, and like reference numerals have been used for like parts as appropriate. Similarly, the exercise arm and strap handle assembly of FIG. 28 is identical to that of FIG. 19, apart from its attachment location on the frame, and like reference numerals have been used as appropriate. FIG. 19 illustrates exercise arms 98 pivoting on a bottom or base strut of the exercise machine frame. FIG. 28 illustrates the same arms 98 pivoting on the top strut 72 of the exercise machine frame.

The machine frame also includes a base strut 180 and a generally upright strut 182, and a weight stack 184 linked to an upper pivoted member or arm 185 via a cable and pulley linkage, as described in my U.S. Pat. No. 5,236,406, the contents of which are incorporated herein by reference. A user seat 186 is supported on the base and upright struts in a conventional manner. A flexible strap handle 93 is secured to each exercise arm 98 via flexible line or cable 94 which extends from handle 93, between pulleys 106 at the end of arm 98, then around pulley 124 on slide member 125, and back to an anchor 126 at the end of the arm. The extension of handle 93 can be adjusted by moving slide member 125 along the arm and locking it in a new position using lock pin 128.

The user can sit on the seat 186 facing away from the exercise arms 98 in order to perform pressing type exercises, similar to those depicted in FIGS. 5, 6 and 10. Alternatively, the user may sit facing the exercise arms and perform pulling type exercises, similar to those depicted in FIGS. 3 and 4. The adjustability of the handles 93 allows the user to tailor the ideal starting positions of the handles to the exercise to be performed. Any of the adjustable handle alternatives of FIGS. 16 to 18 or 20 to 24 may be used in place of the exercise arm 98 and handle assembly of FIG. 28.

Figure 29:
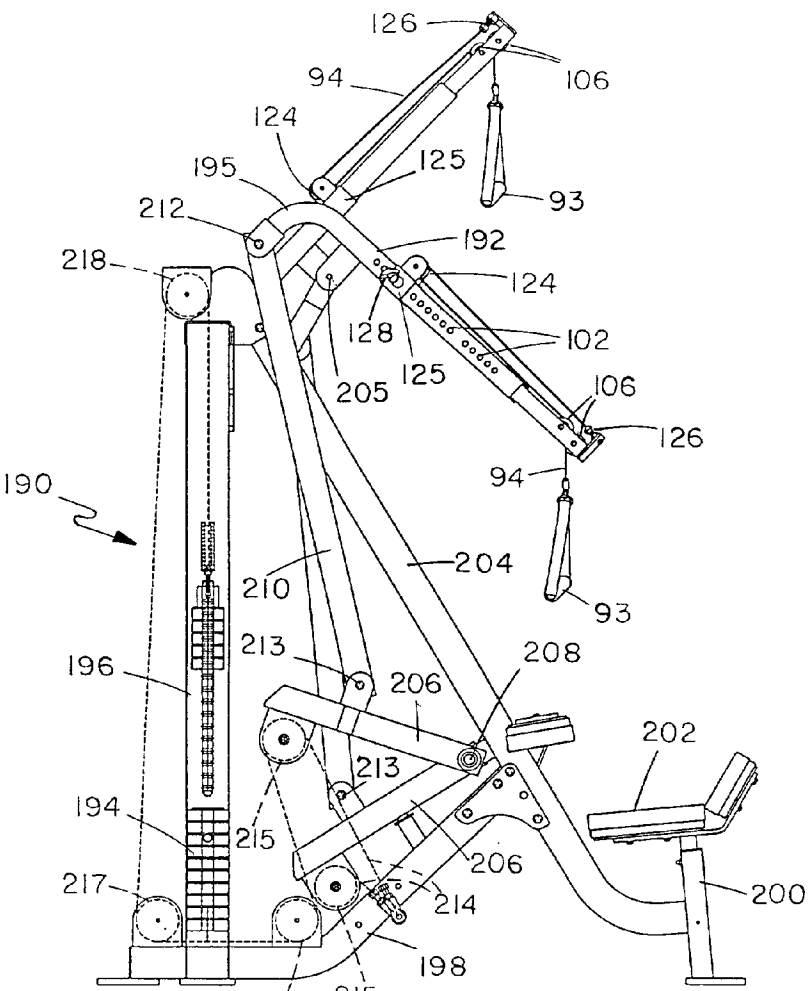
FIG. 29 is a side elevational view of another modified exercise apparatus with independent exercise arms.

FIG. 29 illustrates an exercise machine 190 having a pair of independent exercise arms 192 each pivoted to the upper end of a rearwardly inclined, upright frame member or strut 204 and connected to the exercise resistance, which may be a weight stack 194 as indicated, via a multi-bar linkage system as generally described in my co-pending application Ser. Nos. 09/772,812 filed Jan. 30, 2001 and 10/254,386 filed Sep. 25, 2002, the contents of which are incorporated herein by reference. Each exercise arm is similar to the arm 98 of FIG. 19, apart from the curved end portion 195, and like reference numerals have been used for like parts as appropriate. It will be understood that any of the exercise arms and handle assemblies of FIGS. 16–18 or 20–24 may be used in place of the arms 192.

The exercise machine 190 basically comprises a frame having a rear, vertical member 196 where the weight stack is located, a base strut 198, a seat supporting strut 200 supporting seat 202, and a rearwardly and upwardly inclined strut 204 extending rearwardly from seat supporting strut 200, with the base strut 198 being secured to the inclined strut 204 as indicated. Two identical exercise arm assemblies are pivotally mounted on the frame on each side of the inclined strut 204. Each exercise arm assembly comprises the respective exercise arm 192 which is pivoted to the upper end of the rearwardly and upwardly inclined strut 204 via pivot 205, a second pivoting arm 206 pivoted to the strut 204 at a location spaced below arm 192 via pivot 208, and a connecting link 210 having a first end pivoted to the rear end of exercise arm 192 via pivot pin 212 and a second or lower end pivoted to the arm 206 at a location spaced between the arm ends via pivot 213. Each arm 206 is linked to the weight stack 194 via a cable and pulley linkage. Cable 214 extends from the base strut 198 around a pulley 215 at the rear end of arm 206, a pair of pulleys 216, 217 on the base strut, a pulley 218 at the upper end of vertical member 196, and down to the weight stack 194. This arrangement provides a four bar linkage between each exercise arm and the weight stack, as well as a counterweight provided by the generally vertical connecting link 210.

As in FIG. 19, a flexible strap handle 93 is secured to each exercise arm 192 via flexible line or cable 94 which extends from handle 93, between pulleys 106 at the end of arm 192, then around pulley 124 on slide member 125, and back to an anchor 126 at the end of the arm. The extension of handle 93 can be adjusted by moving slide member 125 along the arm and locking it in a new position using lock pin 128.

FIG. 29 illustrates the exercise arms pivoting on the upright tube or strut of the frame, and also illustrates a split exercise arm assembly which allows a user to operate the exercise arms independently or separately, one at a time, or bilaterally (both arms pulling down together), with each arm being independently connected to the load. Any of the exercise arms of FIGS. 16–18 or 20–24 may be substituted for the exercise arm illustrated in FIG. 28 or FIG. 29, and may be pivoted at the locations illustrated in FIGS. 28 and 29 instead of to the base strut of the frame. These arms may also be used either as dependent exercise arms, or on split/independent exercise arms as in FIG. 29.

Each of the embodiments described above has a rigid, pivoted exercise arm which follows a fixed arcuate path, combined with flexible handles attached to the arm by a flexible strap portion of variable length, or by a flexible line. The flexible handles and strap or line provide multi-dimensional movement. This combines the advantages of prior art flexible line machines with the advantage of a movable rigid arm. The flexible strap handle incorporates all the features and benefits of the arms with rigid handles pivotally attached to the arms by three and four dimensional pivots or universal joints, but is substantially easier and more cost efficient to manufacture, as well as being more comfortable and easier to use than the prior art rigid arms with pivoted handle arms. A flexible strap or line does not require pivots, swivels or universal joints, which also makes it easier to guide the handle through a user-defined exercise path. The handle can easily adapt the user's hand and wrist positioning, providing unlimited adjustability in pronation/supination, flexion/extension, and rotation. This is not possible with a rigid handle.

Another problem with the elongated three dimensionally adjustable handles found in the prior art is the weight of the handles. The user must keep the handles elevated when using them to perform an exercise. This involves the use of shoulder muscles, which will fatigue faster than the chest muscles, causing the user to shorten the number of exercise repetitions performed. Because of this, the user may not receive the full benefit from press or fly exercises by bringing the chest muscles to exhaustion. This would not be true of the flexible strap or line handle attachment, which is much lighter and easier to control and maneuver. This is a real advantage for weaker users, such as children, seniors, and patients recovering from surgery or injury involving the shoulders or hands, where grip strength can be an issue.

The flexible line or flexible strap handle arrangements of this invention allow the user to guide the handles through multiple planes, providing converging or diverging movement. The handle assemblies work equally well for pushing and pulling exercises. The flexible line or strap attaching the handle to the exercise arm is safer for the user, since it will "give" when it makes contact with the body, unlike a rigid, elongated handle arm as is found in the prior art. The exercise arm assembly with attached flexible strap or line connected to handles allows an exerciser to perform all major upper body exercises using just one exercise station, where at least three separate stations were required in the past. If desired, an additional short fixed handle such as handle 90 of FIG. 15 may be attached to the exercise arm in any of the above embodiments, to provide another gripping option for lat pull or mid-row exercises, although this is not necessary since the flexible handle may alternatively be used for such exercises.

In the first embodiments described above in connection with FIGS. 1 to 13, interchangeable or adjustable length flexible strap handles are used to perform all of the various pushing and pulling exercises, while in FIGS. 16 to 24, 28 and 29 a flexible line attached to the handle is adjusted to change the handle extension for performing the same exercises. Pulling exercises that tend to travel in a straighter exercise path and are performed facing the handles, such as lat pull or mid-row, will be performed using a short strap handle or a handle with a flexible line in a retracted position. Other pulling exercises which travel in more arcing or multi-planar paths, such as upright-row, rear deltoid fly, or biceps curl, will be performed with longer strap handles or the flexible line extended further outwardly from the exercise arm. Pushing exercises such as chest, shoulder and triceps presses, and the pectoral fly, will require the longest strap handle or the flexible line at a more extended position from the arm. This invention provides a handle which can be adjusted to any suitable position relative to the exercise arm, and which is secured to the exercise arm by a flexible strap or line, to allow all upper body exercises to be performed readily and comfortably at the same exercise station.

Although some exemplary embodiments of the invention have been described above by way of example only, it will be understood by those skilled in the field that modifications may be made to the disclosed embodiments without departing from the scope of the invention, which is defined by the appended claims.

I claim:

1. An exercise apparatus, comprising:

a support frame;

an exercise arm assembly pivotally linked to the support frame for swinging movement in at least one fixed arc about a first pivot axis, the exercise arm assembly comprising at least one rigid, elongate exercise arm, a rigid elongated handle arm having a first end pivotally attached to said exercise arm, and at least one flexible handle assembly secured to the exercise arm;

the handle assembly having a hand grip portion for gripping by a user, and an elongated flexible connecting portion securing the hand grip portion to the respective exercise arm;

the elongated flexible connecting portion having a first end secured to said hand grip portion, and being adjustably secured to the exercise arm to vary an extension of said connecting portion from said exercise arm, whereby variation of the length of the flexible connecting portion allows a user to perform different types of exercise using the same exercise arm assembly.

2. The apparatus as claimed in claim 1, wherein said hand grip portion is triangular, having an apex, a pair of arms extending from the apex, and a base connecting the arms, the base comprising a cylindrical, resilient hand grip member, and the hand grip portion being secured to said connecting portion at said apex.

3. The apparatus as claimed in claim 1, wherein a pair of flexible handle assemblies are secured to the exercise arm for gripping by the user's left and right hands, respectively.

4. The apparatus as claimed in claim 1, wherein the exercise arm assembly comprises a pair of rigid, elongate exercise arms, a first flexible handle assembly secured to one of said exercise arms and a second flexible handle assembly secured to the other of said exercise arms.

5. The apparatus as claimed in claim 1, including an exercise resistance linked to said exercise arm assembly for providing an exercise resistance, said exercise arm assembly being uni-directional and providing exercise resistance on rotation in one direction about said pivot axis.

6. The apparatus as claimed in claim 1, including an exercise resistance linked to said exercise arm assembly for providing an exercise resistance, said exercise arm assembly being bi-directional and providing exercise resistance on rotation in both directions about said pivot axis.

7. The apparatus as claimed in claim 1, wherein said connecting portion comprises a flexible line and each exercise arm has at least one guide device for said line and one locating device for said line, the line extending from said handle portion around said guide device and at least up to said locating device, at least one of said devices being adjustable to vary the extension of said line from said guide device up to said hand grip portion in order to vary a spacing between said exercise arm and hand grip portion.

8. The apparatus as claimed in claim 7, including a slide member adjustably mounted on said exercise arm and a releasable lock member for releasably securing said slide member in a selected position, one of said devices being secured to said slide member.

9. The apparatus as claimed in claim 8, wherein said locating device comprises an anchor for an end of said line.

10. The apparatus as claimed in claim 9, wherein said exercise arms each have an outer free end, said anchor is located on said slide device, and said line has an end secured to said anchor, said guide members being provided at the outer ends of the respective exercise arms.

11. The apparatus as claimed in claim 9, wherein said guide member is mounted on said slide device, and said anchor is provided at a fixed location on said exercise arm, said line having an end secured to said anchor.

12. The apparatus as claimed in claim 8, wherein said exercise arm has two spaced guide members around which said line extends, one of said guide members being mounted on said slide device.

13. The apparatus as claimed in claim 7, wherein each exercise arm comprises a one-piece elongate member of fixed length.

14. The apparatus as claimed in claim 7, wherein each exercise arm comprises a first, tubular member pivoted to said frame, a second member telescopically engaging said tubular member and extending outwardly from said tubular member, and a releasable locking device for releasably securing said second member at a selected extension relative to said first member.

15. The apparatus as claimed in claim 8, wherein said line has opposite ends and first and second hand grip portions are secured to the respective opposite ends of said line, said line extending from said first hand grip portion, around said guide and locating devices, and up to said second hand grip portion.

16. The apparatus as claimed in claim 15, wherein said guide and locating devices both comprise pulleys.

17. The apparatus as claimed in claim 15, including an additional guide device spaced from said guide and locating devices at an outer end of said exercise arm, said line extending in a path around said guide and locating devices and around said additional device.

18. The apparatus as claimed in claim 17, wherein said guide devices and said locating device all comprise pulleys.

19. The apparatus as claimed in claim 4, wherein said exercise arms are separate and move independently.

20. The apparatus as claimed in claim 4, wherein said exercise arms are connected together and move in unison about said first pivot axis.

21. The apparatus as claimed in claim 1, wherein said support frame has a base and an upright strut projecting upwardly from said base.

22. The apparatus as claimed in claim 21, wherein said exercise arm assembly is pivotally connected to said base.

23. The apparatus as claimed in claim 21, wherein said exercise arm assembly is pivotally connected to an intermediate location on said upright strut.

24. The apparatus as claimed in claim 21, wherein said support frame has a top strut at an upper end of said upright strut, said exercise arm assembly being pivotally suspended from said top strut.

25. The apparatus as claimed in claim 1, including an exercise resistance linked to the exercise arm assembly.

26. The apparatus as claimed in claim 25, wherein the exercise resistance is directly mounted on the exercise arm.

27. The apparatus as claimed in claim 25, including a linkage mechanism linking the exercise arm assembly to the exercise resistance.

28. The apparatus as claimed in claim 27, wherein the linkage mechanism comprises a multi-bar linkage.

29. The apparatus as claimed in claim 1, wherein a single pivot connects the exercise arm assembly to the frame.

30. The apparatus as claimed in claim 1, further comprising a multi-bar pivot linkage connecting the exercise arm assembly to the frame.

31. An exercise apparatus, comprising:

a support frame:

an exercise arm assembly pivotally linked to the support frame for swinging movement in at least one fixed arc about a first pivot axis, the exercise arm assembly comprising at least one rigid, elongate exercise arm and at least one flexible handle assembly secured to the exercise arm;

the handle assembly having a hand grip portion for gripping by a user, and a flexible connecting portion securing the hand grip portion to the respective exercise arm;

the flexible connecting portion having a first end secured to said hand grip portion, and being adjustably secured to the exercise arm to vary an extension of said connecting portion from said exercise arm; and said exercise assembly further comprising a rigid, elongate handle arm having a first end pivotally attached to said exercise arm and a second end forming a hand grip for selective gripping by a user, and a clip for releasably retaining said rigid handle arm against said exercise arm when not in use.

* * * * *